US012735886B2

(12) United States Patent
Knudsen et al.

(10) Patent No.: US 12,735,886 B2
(45) Date of Patent: Sep. 15, 2026

(54) MODULE SYSTEM FOR AN UNDERGROUND STORMWATER RETENTION BASIN, PARTS FOR SUCH MODULE SYSTEM AND STORMWATER RETENTION BASIN AND METHODS OF BUILDING SUCH STORMWATER RETENTION BASIN

(71) Applicant: URBAN WATER RETENTION APS, Helsinge (DK)

(72) Inventors: Lars Rikki Knudsen, Tisvildeleje (DK); Christian Rosenvinge, Hillerød (DK); Benny Frank Jensen, Roskilde (DK); Andy Hoang, Gentofte (DK)

(73) Assignee: URBAN WATER RETENTION APS, Helsinge (DK)

( * ) Notice: Subject to any disclaimer, the term of this patent is extended or adjusted under 35 U.S.C. 154(b) by 39 days.

(21) Appl. No.: 18/867,326

(22) PCT Filed: May 17, 2023

(86) PCT No.: PCT/DK2023/050122
§ 371 (c)(1),
(2) Date: Nov. 19, 2024

(87) PCT Pub. No.: WO2023/222174
PCT Pub. Date: Nov. 23, 2023

(65) Prior Publication Data

US 2025/0215680 A1 Jul. 3, 2025

(30) Foreign Application Priority Data

May 19, 2022 (EP) ..... 22174236
Jan. 26, 2023 (EP) ..... 23153470

(51) Int. Cl.
*E03F 1/00* (2006.01)

(52) U.S. Cl.
CPC ..... *E03F 1/005* (2013.01)

(58) Field of Classification Search
None
See application file for complete search history.

(56) References Cited

U.S. PATENT DOCUMENTS 5,810,510 A * 9/1998 Urriola ..... E02B 11/005 210/170.03
10,597,861 B2 3/2020 Miskovich
(Continued)

FOREIGN PATENT DOCUMENTS

KR 20120122743 A * 11/2012 ..... E03F 5/101
KR 20170030270 A 3/2017
(Continued)

OTHER PUBLICATIONS

International Search Report mailed on Feb. 10, 2023, in connection with corresponding International Application No. PCT/DK2023/050122 (6 pp.).

*Primary Examiner* — Kyle Armstrong
(74) *Attorney, Agent, or Firm* — McCormick, Paulding & Huber PLLC

(57) ABSTRACT

A module system for use as an underground stormwater retention basin, where the module system parts consist of a plurality of watertight three-dimensional units such as cuboids. Each of the watertight three-dimensional units has one or more through holes selected from a female through hole and a male through hole. A female through hole is for insertion of a flange of a male through hole. A male through hole has a flange for insertion into a female through hole. The disclosure further discloses various additional parts for the module system of the underground stormwater retention
(Continued)

basin, to methods of building an underground stormwater retention basin and to a use of an underground stormwater retention basin.

14 Claims, 32 Drawing Sheets

(56) References Cited

U.S. PATENT DOCUMENTS

| | | | | |
|---|---|---|---|---|
| 2009/0279953 | A1* | 11/2009 | Allard | E03F 1/005 405/39 |
| 2010/0021236 | A1* | 1/2010 | Kreikemeier | E03F 1/005 405/55 |
| 2014/0105684 | A1* | 4/2014 | Allard | E02B 11/00 405/52 |
| 2016/0312427 | A1 | 10/2016 | De Groot | |
| 2016/0369490 | A1 | 12/2016 | Rotondo et al. | |
| 2017/0328052 | A1* | 11/2017 | Kent | E03F 1/002 |
| 2018/0100300 | A1 | 4/2018 | Vitarelli et al. | |

FOREIGN PATENT DOCUMENTS

| | | | |
|---|---|---|---|
| WO | 2007099371 | A2 | 9/2007 |
| WO | 2009140295 | A1 | 11/2009 |

* cited by examiner

MODULE SYSTEM FOR AN UNDERGROUND STORMWATER RETENTION BASIN, PARTS FOR SUCH MODULE SYSTEM AND STORMWATER RETENTION BASIN AND METHODS OF BUILDING SUCH STORMWATER RETENTION BASIN

CROSS-REFERENCE TO RELATED APPLICATIONS

This application is a National Stage application of International Patent Application No. PCT/DK2023/050122, filed on May 17, 2023, which claims priority to European Patent Application No. 22174236.4, filed May 19, 2022, and 23153470.2, filed Jan. 26, 2023, each of which is hereby incorporated by reference in its entirety.

TECHNICAL FIELD

The invention relates to a module system for use as underground stormwater retention basin. The invention also relates to various additional parts for the system. The invention also relates to such underground stormwater retention basin, to a method of assembling three-dimensional units of the underground stormwater retention basin and for use of the underground stormwater retention basin.

The invention is not related so-called stormwater detention. In the present technical field of the invention, a difference exists between stormwater retention and stormwater detention. Systems for stormwater retention are capable of retaining stormwater for a relatively long period of time. Systems for stormwater detention are only capable of detaining water for a shorter period of time. If stormwater detention systems are to not only detain stormwater for a shorter period of time, but also are to retain stormwater for a longer period of time, a water-impermeable membrane is wrapped around modules only capable of water retention. The technical filed of the present invention defies use of a water-permeable membrane being wrapped around the modules for the modules to be water retaining, in contrary to only being water detaining.

BACKGROUND

Prior art underground stormwater retention systems are often provided with perforations and are therefore capable of only retaining stormwater a certain reduced period of time or capable of also detaining stormwater at a certain prolonged period of time. Such systems have a need for encapsulating the stormwater system in an elastomeric foil often called a geomembrane made of, as example, EPDM, PP, PEHD, or a textile sheet often called a geotextile. Such membranes do not constitute an integrated part of each of the stormwater detaining modules but are wrapped as huge foils around all the modules, during positioning in the ground, to make the stormwater detaining system watertight. Wrapping membranes around the modules is very cumbersome.

The present invention relates to a stormwater detaining system without perforations in the three-dimensional units constituting the modules for building the underground stormwater retention system, without a need for encapsulating the stormwater system in a geomembrane for making the modules watertight, capable of retaining water.

WO2009/140295 discloses modular units, associated component parts, and assemblies of the modular units and component parts, including filtration systems, that are useful for making and using underground water management systems. The component parts are not capable of detaining stormwater for a prolonged period of time. Furthermore, even embodiments being solid are not watertight when assembled.

US 2016/0312427 A discloses an embankment support with an upper side for receiving flowing water and directing the water along the operatively upper side of the embankment support, thereby dispersing the water in a desired direction. Sides of the embankment support may have a plurality of perforations to allow water penetration through the embankment support. The embankment support is not watertight.

U.S. Pat. No. 10,597,861 B discloses modular trays with a top surface and sides, preferably four-sides, and ending in a peripheral edge of the fides. Each side further defines respective corner legs positioned distant apart, centre legs. The top surface of each modular tray has a plurality of through holes in communication with an internal cavity. The holes provide for the passage of water or other fluids from above the tray through the top surface and into the internal cavity. The modular trays are not watertight.

WO2009/140295 A1 discloses arched module components for use in underground water management systems comprising a half-cube structure having a substantially square top face having a circular opening and pillars that extend downward from each corner. The pillars define four arches useful for making and using underground water management systems. The module components connect at distant ends of the pillars and do not provide any means for making the connection between the components watertight.

It may be an object of the invention to provide a module system capable of not only detaining water, but also for retaining water, for an increased period of time compared to prior art systems and without wrapping any membranes around the modules.

It may also be an object of the invention to provide a module system capable of being buried underground at a level closer to ground level than prior art systems.

It may also be an object of the invention to provide a module system capable of being transported and stored at reduced space and/or at reduced costs.

It may also be an object of the invention to provide a module system capable of being buried underground at locations with obstacles in the ground.

It may also be an object of the invention to provide a module system capable of being provided with additional parts suiting various needs of the system.

It may also be an object of the invention to provide a module system capable of only some modules, and not all modules, being dug out of the ground for possible access underneath the modules, and afterwards digging the modules, possible also or instead digging new modules, into the ground for re-establishing the module system in full.

SUMMARY

The objects of the invention may be obtained by A unit for a module system for use as underground stormwater retention basin, the unit being a three-dimensional unit comprising at least one main surface and at least three side surfaces, each of said side surfaces extending from common boundaries between the at least one main surface and the respective side surface, and where neighbouring side surfaces are angled in relation to each other, each of the side surfaces having side edges extending from corners of the at least one main surface, and each of the side edges of one side surface being mutually joined with a side edge of another, neighbouring side surface, where the three-dimensional unit has an inner volume and at least one through hole in one of the side edges, said three-dimensional unit when connected to at least one other three-dimensional unit forming a watertight module either allowing water to be contained inside the three-dimensional unit or, with the proviso of the three-dimensional unit having at least two through holes, allowing water to pass through the three-dimensional unit from one through hole in one side surface to another through hole in another side surface, and where the at least one through hole is either a female through hole or a male through hole, and with the proviso that the through hole is a female through hole, the through hole is for insertion of an insert flange of a male through hole of another three-dimensional unit, and with the proviso that the through is a male through hole, the through hole has an insert flange for insertion into a female through hole of another three-dimensional unit which three-dimensional unit is made from at least two individual parts being mutually joined, thereby forming an inner volume of the three-dimensional unit, each individual part having one of the following: at least part of the main surface, at least part of the side surfaces, at last parts of both the main surface and the side surfaces, and at least one of the at least two individual parts having at least one of the following: part of a female through hole, part of a male through hole, an entire female through hole, an entire male through hole, and where at least part of each of the side surfaces has a free edge directed oppositely to the common boundary between the at least one main surface and each of the side surfaces, each of said free edges having means for connecting, in a watertight manner, with free edges of side surfaces of another individual part of the three-dimensional unit enabling forming a watertight three-dimensional unit made from the at least two individual parts the means for connecting, in a watertight manner, the free edges with free edges of side surfaces of another individual part of the three-dimensional unit consisting in at least one of a longitudinal bead and a longitudinal groove, said bead or groove intended for engaging a corresponding groove and bead, respectively, along free side edges of side surfaces of another individual part of the three-dimensional unit, and with the proviso of the individual part of the three-dimensional unit having a groove, possibly an elastomeric liner provided in the groove of the individual part, the possible elastomeric liner intended for engaging a corresponding bead along free side edges of side surfaces of another individual part of the three-dimensional unit.

Assembling three-dimensional units for a module system for use as underground stormwater retention basin by using male through holes and female through holes provides an easy, fast and reliable assembly of the units constituting the module system.

Making the three-dimensional unit of at least two individual parts mutually connected along free edges in a watertight manner, that is by providing specific means for making the connection between free edges of the at least two individual parts water-tight, provides a three-dimensional unit capable of retaining an amount of stormwater, while at the same time obtaining the advantage of dividing the three-dimensional unit into smaller-sized parts during manufacture, eliminating the disadvantage of having to produce manufacture the three-dimensional unit as a monolithic structure.

According to a preferred embodiment of the invention, the female through hole has a support flange extending along a circumference of the female through hole, said support flange intended for limiting an axial extension of a ring-shaped seal and intended for abutting one ring-shaped surface of the ring-shaped seal, and the male through hole has an insert flange intended for being inserted into a female through hole of a neighbouring three-dimensional unit, and an outer circumference of the insert flange intended for holding the ring-shaped seal and intended for abutting another ring-shaped surface of the ring-shaped seal.

The female through hole and the male though hole having a support flange and outer circumference, respectively, for abutting various outer surfaces of one and the same ring-shaped seal provides a water-tight connection between neighbouring three-dimensional units, when the flange of a male through hole of one three-dimensional unit extends into the female through hole of another neighbouring three-dimensional unit.

According to a possible embodiment of the invention, at least three side surfaces have free side edges extending opposite to common boundaries between boundaries of the at least one main surface and the side surfaces, where the free side edges extend between the joined edges so that the free edges constitute a circumference of an opening of a semi-sized part of a three-dimensional unit, the opening not being a through hole, the opening intended for being closed by the free edges of the one semi-sized part of the three-dimensional unit being assembled with, in a watertight manner, congruent free edges of another semi-sized part of the three-dimensional unit, and at least one side surface of the semi-sized part of the three-dimensional unit having a part of a through hole, the part of the through hole preferably being a part of one of a female through hole or a male through hole.

Manufacturing the three-dimensional unit by semi-sized parts of a three-dimensional unit provides a possibility of manufacturing the there-dimensional unit faster, cheaper and with more features, as example, external or internal ribs for more stiffness of the unit.

The three-dimensional unit or part of a three-dimensional unit may be selected among the following unit shapes: a cuboid, such as a cube, and with right angles between all surfaces, a cuboid, such as a cube, and with non-right angles between at least some of the surfaces, a prism with polygonal cross-section of the at least one main surface, where the polygonal cross-section of the prism preferably being an equilateral triangular shape or an equilateral hexagonal shape, a cylinder with polygonal cross-section of the at least one main surface, where the polygonal cross-section of the cylinder preferably being an equilateral triangular shape or an equilateral hexagonal shape, a cylinder with a circular cross-section or an oval cross-section of the at least one main surface.

The three-dimensional unit may be manufactured by one of the following processes: casting or moulding as a full-sized module system unit having a geometry and size of a full-sized tree-dimensional unit, casting or moulding as a semi-sized module system unit having a geometry and size being a division of a full-sized three-dimensional unit.

Preferably, the three-dimensional unit, also with the proviso that the three-dimensional unit is made from at least two parts and is exhibiting at least two main surfaces, has at least one main surface capable of withstanding a load of at least 60 kN per $m^2$, preferably a load of at least 150 kN per $m^2$, possibly a load of at last 300 kN per $m^2$, in a direction perpendicular to the at least one main surface.

The cuboid according to the invention is capable of withstanding high loads. Load tests have been performed. One test is performed with a beam having a length of 600 mm and a width of 200 mm, the beam being placed in the middle of the top main surface of the cuboid and provided with a load of 117 kN per $m^2$. Another test is performed with a square plate being 600 mm wide along each edge, the plate being placed in the middle of the top main surface of the cuboid and provided with a load of 150 kN per $m^2$.

During the load test with the beam and with the square plate, a bending down of the top main surface and/or the side surfaces is as small as 1-10 mm, possible only 1-5 mm. Thus, the cuboid according to the invention may be installed underground with a layer of gravel being of a lesser thickness between the top main surface of the cuboid and a top surface of the road, pavement or other upper ground surface, with the cuboid still being able to withstand a required maximum load and the cuboid still being able to exhibit a required minimum bending down of the top main surface and/or of the side edges.

| | | | |
|---|---|---|---|
| Load at 35 cm cover incl. 7 cm asphalt/tiles | Wheel load kN/0.12 $m^2$ | 40 | 35 |
| Load by 35 cm cover incl. 7 cm asphalt/tiles (axle load) | Axle load kN | 80 | 70 |
| Load (axle load) at 40 cm. cover incl. 7 cm. asphalt/tiles (EU max. axle load 60 kN) | Wheel load kN/0.12 $m^2$ | 65 | 50 |
| Load (axle load) at 40 cm. cover incl. 7 cm. asphalt/tiles (EU max. axle load 115 kN) | Axle load kN | 115 | 100 |
| Load at 50 cm. cover incl. 7 cm. asphalt/tiles | Wheel load kN/0.12 $m^2$ | 100 | 100 |
| Load at 50 cm. cover incl. 7 cm. asphalt/tiles | Axle load kN | 200 | 200 |
| Bend down at 150 kN/$m^2$ at 40 cm. build-in depth | mm | 1 | 2 |
| Bend down at 65 kN on load surface of 0.2 × 0.6 m. at 40 cm. build-in depth | mm | 3.5 | 5 |
| Bend down at 100 kN on load surface of 0.2 × 0.6 m. at 40 cm. build-in depth | mm | 6 | 8 |

The three-dimensional unit according to the invention is preferably a full-sized cuboid made from an even number of semi-sized parts of a cuboid, said full-sized cuboid constituted by two substantially rectangular main surfaces being mutually parallel and four side surfaces each being perpendicular to the main surfaces and said numbers of semi-sized parts of a cuboid preferably being two parts, alternatively being four parts.

One or more objects of the invention may be obtained by the three-dimensional unit being a full-sized cuboid made from at least two semi-sized parts of the full-sized cuboid, said full-sized cuboid constituted by two substantially rectangular main surfaces being mutually parallel and four side surfaces, each of the side surfaces having common boundaries between the one main surface and the respective side surface and between the respective side surface and other neighbouring side surfaces, said side surfaces extending perpendicular from edges between the two main surfaces and the side surfaces and opposite said side surfaces being mutually parallel, at least two of the four side surfaces each having side edges provided by connecting free side edges of one semi-sized part of the three-dimensional unit with free edges of the other semi-sized part of the three-dimensional unit, and at least one other side surface having a part of a through hole, the part of the through hole preferably being a part of a substantially full-circular through hole, where the full-sized three-dimensional unit provides an inner volume either allowing water to be contained inside the three-dimensional unit or allowing water to pass through the three-dimensional unit from one through hole in one surface to another through hole in another surface, with the proviso of the three-dimensional unit having at least two through holes, where each through hole is one of a female through hole or a male through hole, and with the proviso that the through hole is a female through hole, the hole is for insertion of a flange of a male through hole, and with the proviso that the part is one of a male through hole, the hole has a flange for insertion into a female through hole.

According to a specifically preferred embodiment of a three-dimensional unit, the three-dimensional unit being a semi-sized part of a three-dimensional unit constituted by one substantially rectangular main surface and four side surfaces, said side surfaces extending perpendicular from edges between the one main surface and the side surfaces and opposite said side surfaces being mutually parallel, each of the side surfaces having common boundaries between the one main surface and the respective side surface, and between the respective side surface and other neighbouring side surfaces, at least two of the four side surfaces each having free side edges extending opposite to and parallel with the common boundaries between the one main surface and each of the at least two side surfaces, and at least one other side surface having a part of a through hole, the part of the through hole preferably being a part of a substantially semi-circular through hole, where at least part of the free side edges, directed oppositely to the common boundaries between the main surface and the side surfaces are provided with means for connecting the free side edges of the semi-sized part of the cuboid with free side edges of another semi-sized part of the cuboid to form a full-sized cuboid, and where the part of the through hole is one of a female through hole or a male through hole, and with the proviso that the part is one of a female through hole, the part is a hole for insertion of a flange of a male through hole, and with the proviso that the part is one of a male through hole, the part is a flange for insertion into a female through hole.

Semi-sized cuboids have the advantage that the production costs are reduced. However, more importantly, specific and selected features like a geometrical shape of the through holes may be manufactures with closer tolerances and with features which may not be possible to produce if the cuboids are manufactures full-sized form start. Also, during transport and storage, it may be possible to stack the semi-sized cuboids in a manner reducing the volume necessary for transporting and storing a certain number of cuboids.

A preferred embodiment of the semi-sized cuboid according to the invention, where a length L1 of two first opposite parallel side surfaces in a direction parallel to the main surface and a length L2 of the two other second parallel side surfaces in a direction parallel to the main surface are the same, the semi-sized part of the cuboid thereby having a substantially square main surface, and where an extension L3 of the side surfaces in a direction perpendicular to the main surface is substantially half the extension of the side surfaces in a direction parallel to the main surface, the semi-sized part of the cuboid thereby forming substantially a semi-sized part of a cubic shape.

Semi-sized cuboids being semi-cubic provides a full-sized cuboid being cubic, when two semi-sized cuboids are assembled to form a full-sized cuboid. Cubic full-sized cuboids may be easier to assemble with each other because of possible orientation in any of six directions of the two main surfaces and the four side surfaces, depending on the layout of the through holes in the cube. Stacking a plurality of cuboids may also be easier.

The objects of the invention may also be obtained by a full-sized cuboid, where a length L1 of two first opposite parallel side surface in a direction parallel to the main surface and a length L2 of the two other second parallel side surfaces in a direction parallel to the main surfaces are the same, the semi-sized part of the cuboid thereby having substantially square main surfaces, and where an extension L3 of the side surfaces in a direction perpendicular to the main surface is substantially the same as the extension of the side surfaces parallel with the main surfaces, the semi-sized part of the cuboid component thereby forming a full-sized cuboid having a substantially cubic shape.

Cubic full-sized cuboids may be easier to mutually assemble because of possible orientation in any of six directions of the two main surfaces and the four side surfaces, depending on the type of cuboids and on the layout of the through holes in the cube. Stacking a plurality of cuboids may also be easier when alle the cuboids are cubic.

According to a preferred embodiment of a three-dimensional unit according to the invention, the three-dimensional unit, also with the proviso that the three-dimensional unit is made from at least two parts and is exhibiting at least two main surfaces, at least one main surface is capable of withstanding a load of at least 60 kN per $m^2$, preferably a load of at least 150 kN per $m^2$, possibly a load of at least 300 kN per $m^2$, in a direction perpendicular to the at least one main surface.

Cuboids capable of withstanding a load of at least 60 kN per $m^2$ or even 150 kN per $m^2$ or even 300 kN per $m^2$ provides a possibility of positioning the cuboids underground with a reduced distance between an uppermost main surface of uppermost cuboids of a stack of cuboids constituting an underground stormwater retention basin and a ground level at the site, where the underground stormwater retention basin is situated. A reduced distance is less than 80 cm, which a distance often used with prior art cubes.

The reduced distance may even be less than 60 cm, or even less than 40 cm.

The distance between the uppermost main surface of uppermost cuboids and the ground level depends on the load of traffic or other loads above the underground stormwater retention basin. The larger the load, the larger the distance between the uppermost main surface of uppermost cuboids and the ground level often needs to be.

According to a preferred embodiment of a three-dimensional unit according to the invention, the three-dimensional unit, when all through holes and any other openings are closed so that any fluid inside an inner volume of the three-dimensional unit cannot escape from the unit, the three-dimensional unit is capable of withstanding a pressure inside the volume of the unit of at least 120000 $N/m^2$, possibly at least 130000 $N/m^2$, even possible at least 140000 $N/m^2$, yet even possible more than 140000 $N/m^2$.

Cuboids capable of withstanding an inner pressure at least 1.2 bars, or even at least 1.3 bars, or even at least 1.4 bars, or even more than 1.4 bars, ensures that the cuboids, when positioned underground, is capable of retaining any stormwater inside the cuboids, and that the stormwater will be retained inside the cuboids for a prolonged period of time. An insurance of stormwater being kept inside the cuboids for a prolonged period of time reduces, or even eliminates, the risk of stormwater seeping out from the cuboids.

Utility of the underground stormwater retention basin and management of the stormwater collected, retained and possibly stored in the underground stormwater retention basin may be enhanced by providing additional parts to be used together with the cuboids.

One possible additional part is a seal insert for being inserted into a full-sized cuboid, the seal insert having a rib extending outwards in relation to a centre axis of the seal insert and defining a closed ring-shaped outer circumference of the seal insert, and the seal insert having at least one flange extending along a direction of the centre axis and defining a closed ring-shaped inner circumference of the seal insert, and the flange intended for insertion into a through hole of a cuboid of the modular system and the inner circumference of the seal insert being smaller than an inner circumference of a through hole, which the seal insert is intended for being inserted into, and the flange having a recess intended for taking up an inner circumference of a ring-shaped seal, said ring-shaped seal intended for sealing between the flange of the seal insert and the through hole, which the seal insert is intended for being inserted into.

A seal insert has the advantage that positioning, installation and maintaining in place a seal between neighbouring cuboids provides a safe manner of providing and over time ensuring a watertight connection between neighbouring cuboids.

The dimension of the seal, as example a diameter of a circular seal, to be used together with a seal insert according to the invention may vary depending on the size of the three-dimensional unit and/or depending on the of the amount of water and/or depending on the speed of flow of water that the underground stormwater retention water basin is required when transporting stormwater.

Preferably, standard-sized seals are used which correspond to standard-sized pipes already used for transporting water underground, not only standard-sized pipes for transporting stormwater, but also for standard-sized pipes transporting water supply and sewage water. Standard-sized pipes may be pipes with a seal connection for using seals with a standard-sized diameter of perhaps 110 mm, 160 mm, 200 mm, 250 mm, 315 mm or 425 mm. In the alternative, special-sized seals may be used corresponding to special-sized pipes.

Even in the alternative, a seal with a diameter of 500 mm, and being able to withstand a pressure of at least 2.5 bar, may be used for allowing as much water as possible to be passed through the three-dimensional units according to the invention an to be transported along the underwater module system according to the invention.

Another possible additional part is a cover for being inserted into a full-sized cuboid, the cover having a rib extending outwards in relation to the centre axis of the cover and defining a closed ring-shaped outer circumference of the cover, and the cover having at least one first flange extending along a direction of the centre axis and defining a closed ring-shaped inner circumference of the cover, and the flange intended for insertion into a through hole of a cuboid of the modular system and the inner circumference of the cover being smaller than an inner circumference of the through hole, which the cover is intended for covering and the flange having a recess intended for taking up an inner circumference of a ring-shaped seal, said ring-shaped seal intended for sealing between the flange of the cover and the through hole, which the cover is intended for covering.

A cover has the advantage that cuboids positioned in a stack of plurality of cuboids and positioned either at the top, at the side or at the bottom of the stack of cuboids, even if the cuboid is a cuboid of the second type, may be closed to the exterior of the cuboid.

Another possible additional part is a grate for being inserted into a full-sized cuboid, the grate having a rib extending outwards in relation to the centre axis of the grate and defining a closed ring-shaped outer circumference of the grate, and the grate having at least one flange extending along a direction of the centre axis and defining a closed ring-shaped inner circumference of the grate, and the flange intended for insertion into a through hole of a cuboid of the modular system and the inner circumference of the grate being smaller than an inner circumference of the through hole, which the grate is intended for being inserted into, and the flange having a recess intended for taking up an inner circumference of a ring-shaped seal, said ring-shaped seal intended for sealing between the flange of the grate and the through hole, which the grate is intended for being inserted into.

A grate has the advantage that cuboids positioned in a stack of plurality of cuboids and positioned either at the top, at the side or at the bottom of the stack of cuboids, even if the cuboid is a cuboid of the second type, may prevent debris from the outside being passed from the exterior to the cuboid or being passed between neighbouring cuboids.

Another possible additional part is a shroud to be inserted into a full-sized cuboid, the shroud having a rib extending outwards in relation to the centre axis of the shroud and defining a closed ring-shaped outer circumference of the shroud, and the shroud having at least one flange extending along a direction of the centre axis and defining a closed ring-shaped inner circumference of the shroud, and the flange intended for insertion into a through hole of a cuboid of the modular system and the inner circumference of the shroud being smaller than an inner circumference of the through hole, which the shroud is intended for being inserted into, and the flange having a recess intended for taking up an inner circumference of a ring-shaped seal, said ring-shaped seal intended for sealing between the flange of the shroud and the through hole, which the shroud is intended for being inserted into, the shroud having side tracks for guiding and holding one of a grate or a screen, the side track extending perpendicular to the centre axis of the shroud, and the shroud comprising one insert selected form a grate or a screen, each insert having side edges for being inserted into the side tracks and intended for partly closing off or fully closing off an opening through the shroud.

A shroud has the advantage that debris and/or water may be prevented, may be allowed or may be partly allowed and/or prevented from passing between neighbouring cuboids.

Another possible additional part is a bucket insert to be inserted into a full-sized cuboid, the bucket insert having a support surface extending outwards in relation to, and perpendicular to, a centre axis of the bucket insert and defining an outer circumference of the bucket insert, and the bucket insert having one flange extending along a direction of the centre axis and defining a closed ring-shaped circumference of the bucket insert and intended for supporting a pipe above the bucket insert, and the bucket insert having another flange extending along a direction of the centre axis and defining a closed ring-shaped circumference of the bucket insert and intended for insertion into a through hole of a cuboid of the modular system, and an outer circumference of the other flange of the bucket insert being smaller than an inner circumference of the through hole, which the other flange of the bucket insert is intended for being inserted into.

A bucket insert has the advantage that debris from the ground via the storm water being passed form the ground towards the module system, may be prevented from passing to the entire module system by being collected in a bucket of a cuboids close to the ground.

Another possible additional part is a wick insert to be inserted into a full-sized cuboid, the wick insert having a support surface extending outwards in relation to, and perpendicular to, a centre axis of the wick insert and defining an outer circumference of the wick insert, and the wick insert having one flange extending along a direction of the centre axis and defining a closed ring-shaped circumference of the wick insert and intended for supporting an outer circumference of a wick material, and the wick insert having another flange extending along a direction of the centre axis and defining a closed ring-shaped circumference of the wick insert and intended for insertion into a through hole of a cuboid of the modular system, and an outer circumference of the other flange of the wick insert being smaller than an inner circumference of the through hole, which the other flange of the wick insert is intended for being inserted into.

A wick insert has the advantage that water from a cuboid close to the ground may be passed to possible plants situated above the cuboid, where the wick insert is inserted.

Another possible part is a bottom plate intended for being inserted into a three-dimensional unit for covering a bottom of the three-dimensional unit, the bottom plate having a central section and side sections, the side sections extending form the central section and outer edges of the side sections constituting part of outer boundaries of the bottom plate, the side sections having grooves extending from the central section to the outer edges of the side sections, the grooves provided at selected distances along the side sections, the selected distances of the groves selected corresponding to ribs along inside surfaces of the three-dimensional unit, which the bottom plate is intended for being inserted into.

A bottom plate may cover any spaces formed between support ribs of the three-dimensional unit. The spaces may unintentionally retain debris being passed into the three-dimensional unit by stormwater passing into or passing through the unit. A bottom plate with a central section and with grooves for interacting with the ribs covers the spaces and eliminates debris being retained in the spaces formed between the ribs of the three-dimensional unit.

The objects of the invention may also be obtained by an underground stormwater retention basin comprising module system parts according to the invention, and the underground stormwater retention basin constituted by a plurality of full-sized cuboids according to the invention being buried in the ground below a ground level of the site, where the retention basin is situated, a number of the plurality of cuboids constituting uppermost cuboids towards the ground level, and a distance between an upper main surface of at least one of the uppermost cuboids and the ground level being less than 80 cm, preferably less than 60 cm, more preferred less than 40 cm.

The objects of the invention may also be obtained by a method of building an underground stormwater retention basin comprising module system parts according to the invention, and the underground stormwater retention basin constituted by a plurality of full-sized cuboids according to the invention, the method comprising the steps of:

providing a plurality of full-sized cuboids of a first type made from two semi-sized cuboids of a first type, and assembling on site of the underground stormwater retention basin the plurality of full-sized cuboids by the following method of assembling:

inserting a flange of a male through hole at a side surface of one cuboid into a female through hole at an opposing side surface of another neighbouring cuboid for assembling a plurality of cuboids of a first type of cuboid, and providing a ring-shaped seal between an outer circumference of the flange of the male through hole of the one cuboid and an inner circumference of the female through hole of the other neighbouring cuboid.

The objects of the invention may also be obtained by a method of building an underground stormwater retention basin comprising module system parts according to the invention, and the underground stormwater retention basin constituted by a plurality of full-sized cuboids according to the invention, the method comprising the steps of:

providing a plurality of full-sized cuboids of a second type made from two semi-sized cuboids a second type and assembling on site of the underground stormwater retention basin the plurality of the full-sized cuboids by the following method of assembling:

inserting one flange of a seal insert into a female through hole of one cuboid and inserting another flange of the seal insert into a female through hole of another neighbouring cuboid, and providing a ring-shaped seal between an outer circumference of each of the flanges of the seal insert and an inner circumference of the female through holes of the one and the other neighbouring cuboids.

The object of the invention may furthermore be obtained by a use of a plurality of module system parts according to the invention for building an underground stormwater retention basin constituted by a plurality of full-sized cuboids according to the invention.

An internal size of a through-hole relative to an external size of the side surface, where the trough hole is provided, is at least 50% preferably at least about 80%.

An internal void volume relative to an external volume of the full-sized cuboids is at least about 80%, at least about 85%, at least about 90%, preferably at least 95%.

A volume of an interior of a three-dimensional unit for a module part according to the invention is preferably at least 100 litres, possibly at least 200 litres, possibly between 200 litres and 400 litres. As example, a three-dimensional unit for a modular part may be a cube a length of the side edges being approximately 60 centimetres resulting in an internal volume of about 200 litres. If the internal volume of the modular part is much larger than 400 litres, the module part may become so large and possibly heavy that the modular part becomes difficult to handle, at least becomes difficult to handle manually.

DETAILED DESCRIPTION

Figure 1:
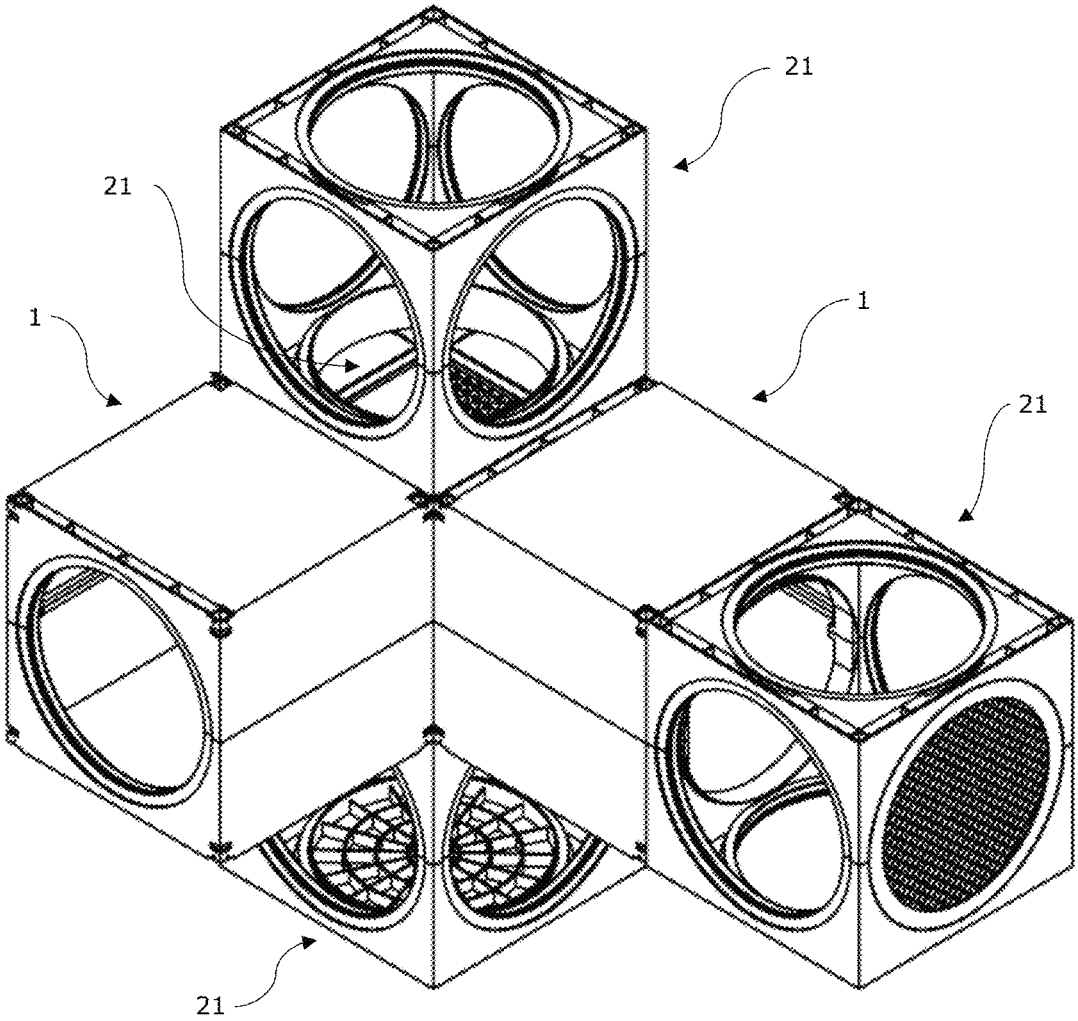
FIG. 1 is a drawing of one module system of an underground stormwater retention basin.

FIG. 1 shows an example of a module system of an underground stormwater retention basin. The layout comprises six full-sized cuboids, however, one cuboid in the centre of the stormwater retention basin only barely visible. One cuboid positioned outermost to the left and one cuboid positioned between the centre cuboid and a cuboid positioned outermost to the right are made of a first type of semi-sized cuboids 1 (see FIG. 3A and FIG. 3B). The remaining four cuboids positioned in the centre, at the top, at the bottom and outermost to the right are made of a second type of semi-sized cuboids 21 (see FIG. 5 and FIG. 6).

In the embodiment of the cuboids shown, all the cuboids are shaped substantially as cubes, that is, all six surfaces of the cuboids are of substantially the same size. In alternative embodiments of the cuboids, the cuboids may be shaped as non-cubic cuboids, that is, two end surfaces are the same size and four side surfaces are the same size, however, the four side surfaces not the same size as the two end surfaces.

The centre cuboid is provided with seal inserts (see FIG. 8) establishing a connection between a through hole in a top side surface of the centre cuboid and a through holes in a bottom side surface of the uppermost cuboid. The cuboid positioned at the bottom is provided with a cover (see FIG. 12) in a through hole in a bottom side surface of the cuboid. The cuboid positioned outermost to the right is provided with a seal insert and a grate (see FIG. 11) in a through hole in a sideway side surface of the cuboid.

Figure 2:
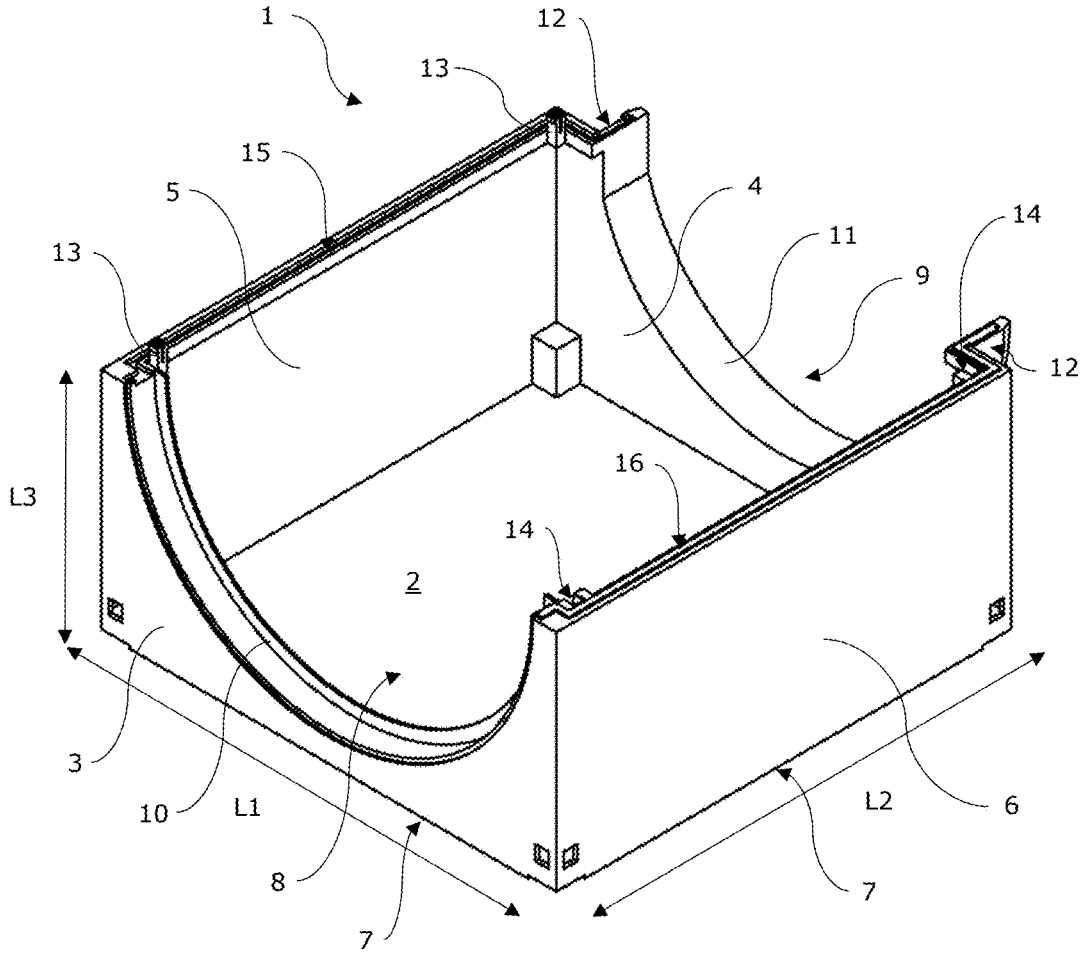
FIG. 2 is a drawing of a semi-sized cuboid for a full-sized cuboid of a first type.

FIG. 2 shows a semi-sized cuboid for a first type 1 of cuboid (see FIG. 1, FIG. 3A, FIG. 3B and FIG. 4). In the embodiment shown, the semi-sized cuboid has a main surface 2 and four side surfaces 3,4,5,6 extending from common boundaries 7 between the main surface 2 and the side surfaces 3,4,5,6. In the embodiment shown, two opposite side surfaces 3,4 have semi-sized through holes 8,9 in the shape of a semi-circle. Two other opposite side surfaces 5,6 are closed. The main surface 2 is closed.

One side surface 3 has a semi-sized through hole 8 intended for constituting part of a full-sized female through hole (see FIG. 3B) capable of engaging with a corresponding male through hole (see FIG. 3A) of a neighbouring cuboid (not shown).

The semi-sized female through hole 8 has a support flange 10 extending along a circumference of the semi-sized through hole 8. The support flange 10 is intended for limiting an axial extension of a ring-shaped seal (not shown) intended for sealing against an inner circumference of the female through hole 8 and against an outer circumference of a male through hole of another cuboid when the female through hole of one cuboid is engaging with a male through hole of neighbouring cuboid.

Another side surface 4 has a semi-sized through hole 9 constituting part of a full-sized male through hole (see FIG. 3A) capable of engaging with a corresponding female through hole (see FIG. 3A) of a neighbouring cuboid (not shown).

The semi-sized male through hole 9 has a flange 11 intended for being inserted into a semi-sized female through hole 8 of a neighbouring cuboid (not shown). The flange 11 has a recess 12. The recess 12 is intended for holding a ring-shaped seal (not shown) intended for sealing against an outer circumference of the recess 12 and against the inner circumference of a female through hole of neighbouring cuboid when the male through hole of one cuboid is engaging with a female through hole of another cuboid.

At selected two corner positions of the side surfaces 3,4,5, protrusions 13 are provided. The protrusions 13 are intended for engaging with corresponding indentions at selected other corner positions of side surfaces of an opposite semi-sized cuboid (not shown) which the one semi-sized shown is to be attached to for forming a full-sized cuboid.

At selected corner positions of the side surfaces 3,4,6, indentions 14 are provided. The indentions 14 are intended for engaging with corresponding protrusions at selected corner positions of side surfaces of an opposite semi-sized cuboid (not shown) which the one semi-sized shown is to be attached to for forming a full-sized cuboid.

Figure 3A:
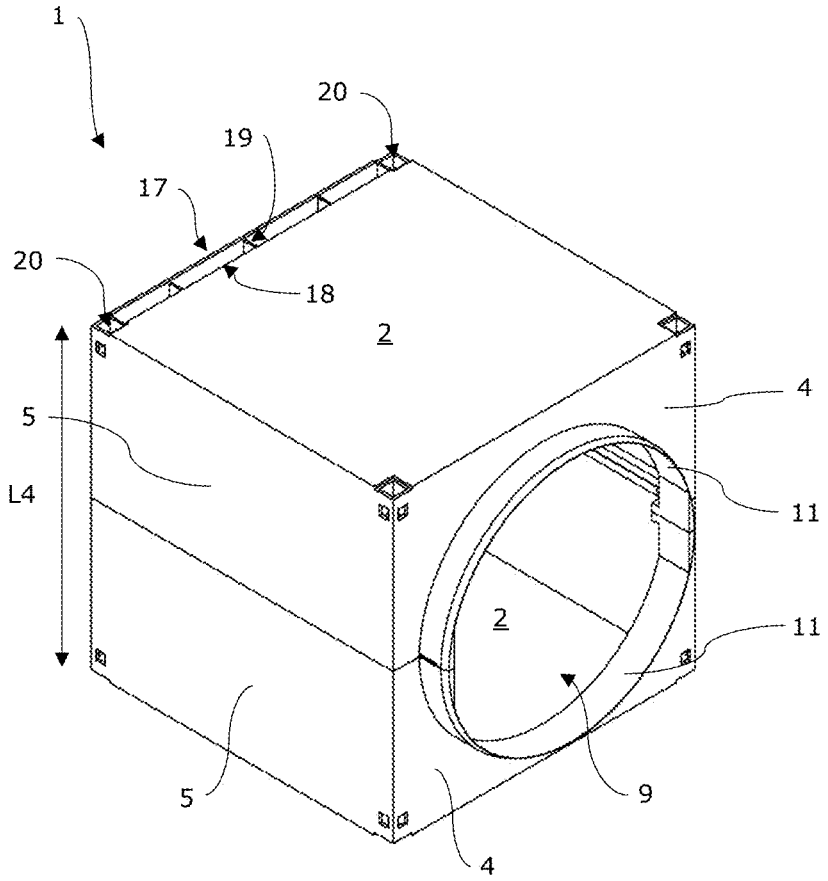
FIG. 3A and FIG. 3B are drawings of a full-sized cuboid of a first type of cuboid.
Figure 3B:
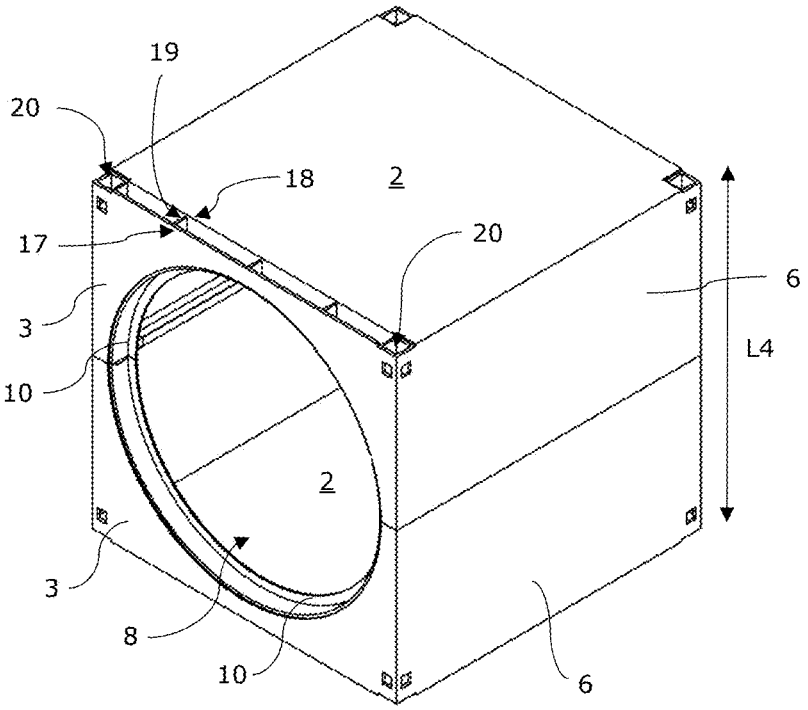

Engagement between the protrusions 13 and the indentions 14 maintain two semi-sized cuboids in position in relation to each other to form a full-sized cuboid (see FIG. 3A, 3B).

Along a free side edge of one closed side surface 5, a longitudinal bead 15 is provided. Along a free side edge of another closed side surface 6, opposite to the one closed side surface 5 with the bead 15, a longitudinal groove 16 is provided. The longitudinal bead 15 and the longitudinal groove 16 are intended for engaging a corresponding groove and bead, respectively, along free side edges of side surfaces of another semi-sized cuboid (not shown), which together with the semi-sized cuboid shown forms a full-sized cuboid.

An elastomeric liner (not shown), such as rubber or another watertight elastomer, may be provided in the groove 16. If mutual engagement between a bead 15 and a groove 16 along free edges of the one semi-sized cuboid shown and another semi-sized cuboid (not shown), which together form a full-sized cuboid, is not watertight, mutual engagement between free side edges of the semi-sized cuboid shown and the other cuboid may become watertight if an elastomeric liner is provided in the grooves 16 of the cuboids.

The semi-sized cuboid of the first type is possibly made from plastic such as polypropylene (PP), preferably with fibres, as example glass fibres, preferably between 0.1 mm and 10 mm long, embedded within the plastic. A thickness of the main surface and of the side surfaces is preferably between 2 mm and 10 mm, preferably between 2 mm and 5 mm. A length L1 of the one pair of opposing side edges of the main surface is possibly between 400 mm and 1000 mm. A length L2 of the one pair of opposing side edges of the main surface is possibly between 400 mm and 1000 mm. A length L3 of the side surface, in a direction perpendicular to the main surface is preferably between 200 mm and 500 mm. The semi-sized cuboid possibly has a volume within the main surface, inner sides of the side surfaces incl. plane areas which possible through holes expand of between 0.6 $m^3$ and 2 $m^3$, preferably between 0.5 $m^3$ and 1 $m^3$.

FIG. 3A and FIG. 3B show a full-sized cuboid of the first type of cuboid, made from two semi-sized cuboids as shown in FIG. 2. The full-sized cuboid has two main surfaces 2, two opposite side surfaces 3,4, each of which has a substantially circular through hole 8,9, and two opposite side surfaces 5,6, each of which are closed. The one side surface 3 has a female through hole 8 and another side surface 4 has a male through holes 9.

The full-sized first type cuboid is intended as a water duct module and/or a water retention module and/or a water detention module of the module system of a stormwater retention basin. In the embodiment shown, at least the side surfaces 3,4,5,6 are made as a sandwich structure. Each side surface is constituted by opposing face plates 17,18 mutually connected by support ribs 19. Thereby, rigidity of the main surfaces and the side surfaces is increased, better capable of withstanding load from the ground and from possible other cuboids positioned above the one cuboid, when the one cuboid together with other cuboids constitute the module system of a stormwater retention basin.

At each corner of the cuboid, locking recesses 20 are provided. The locking recesses 20 are intended for engaging with locking pins of a corner locking part (see FIG. 25).

Figure 4:
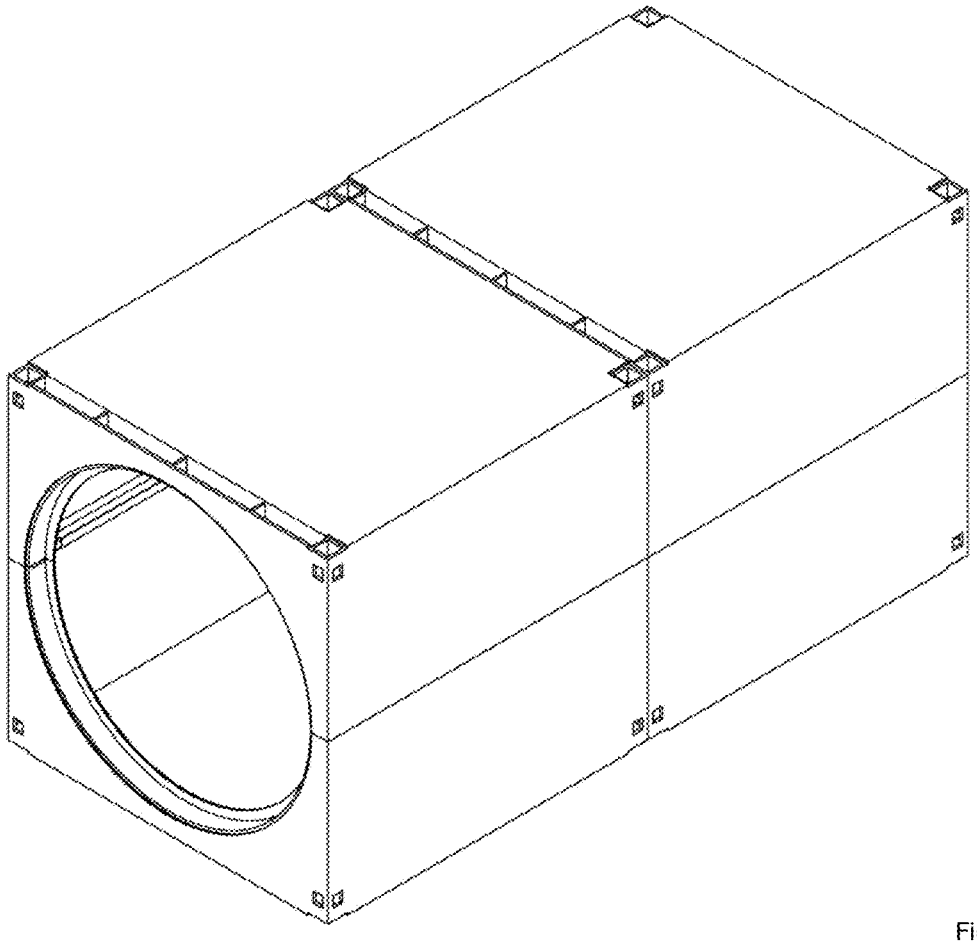
FIG. 4 is a drawing of neighbouring cuboids of the first type mutually attached.

FIG. 4 shows neighbouring first type cuboids mutually attached. A flange 11 of a male through hole 9 (see FIG. 3A) of the cuboid to the left is engaging with the female through hole 8 (see FIG. 3B) of the cuboid to the right. Between an outer circumference of the recess 12 of the flange 11 (see FIG. 3A) and an inner circumference of the female through hole 8 (see FIG. 3A), a ring-shaped seal (not shown) is positioned.

An inner circumference of the ring-shaped seal is sealing against the outer circumference of the recess and an outer circumference of the ring-shaped seal is sealing against the inner circumference of the female through hole. Thereby, mutual engagement between the flange of the male through hole and the female through hole is made watertight.

Figure 5:
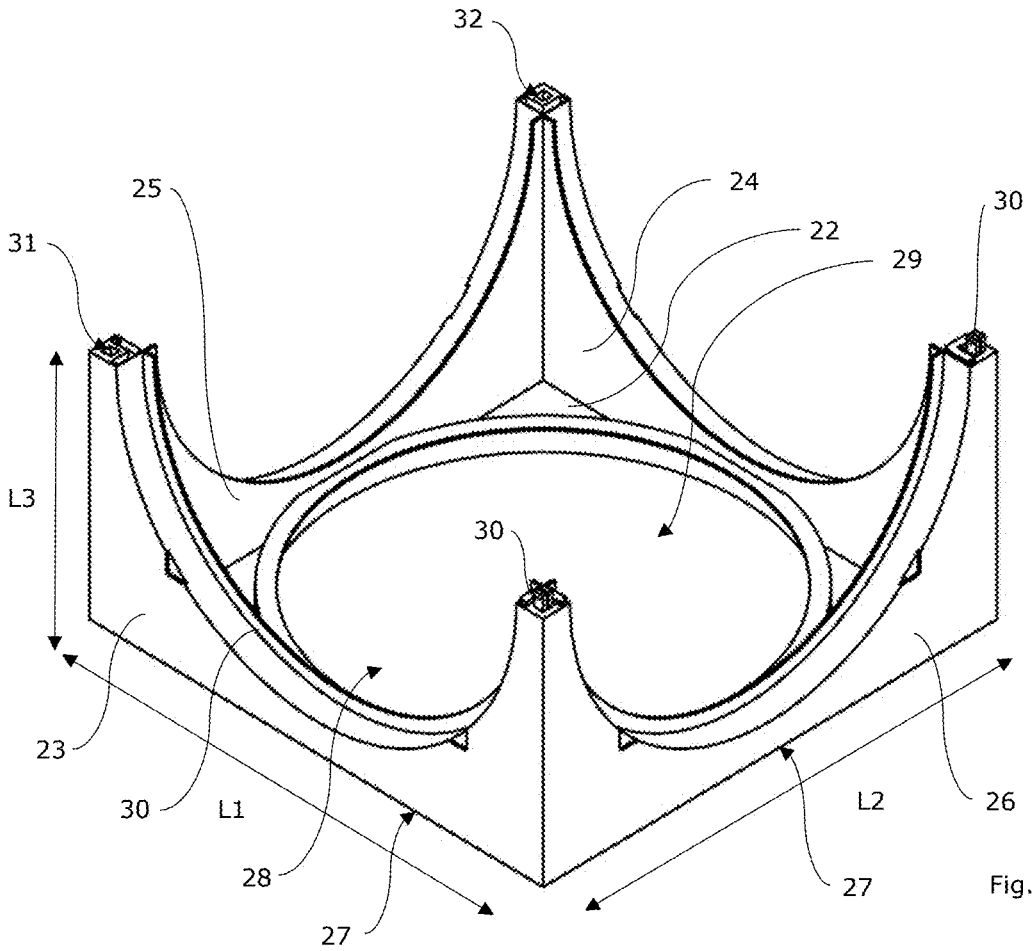
FIG. 5 is a drawing of a semi-sized cuboid for a full-sized cuboid of the second type.
Figure 6:
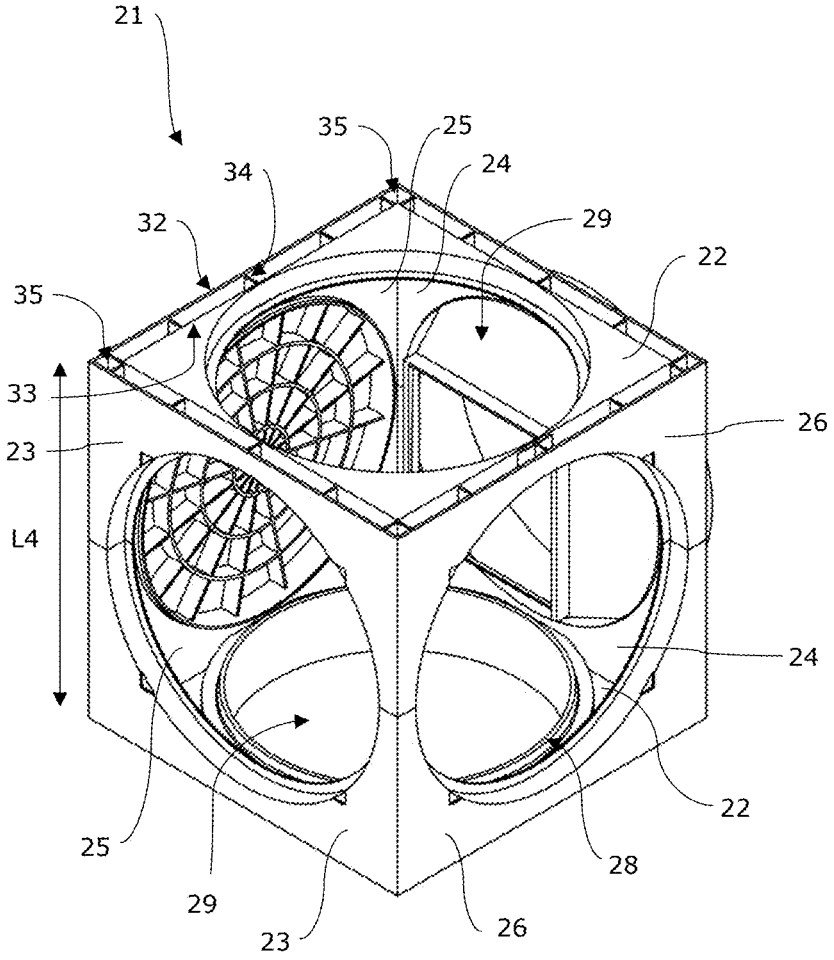
FIG. 6 is a drawing of a full-sized cuboid of the second type of cuboid.

FIG. 5 shows a semi-sized cuboid for a second type 21 of cuboid (see FIG. 1 and FIG. 6). In the embodiment shown, the semi-sized cuboid has a main surface 22 and four side surfaces 23,24,25,26 extending from edges 27 of the main surface 22. In the embodiment shown, all side surfaces 23,24,25,26 have semi-sized through holes 28 in the shape of a semi-circle. The main surface 22 has a full-sized through hole 29.

The semi-sized through holes 28 in the side surfaces 23,24,25,26 are intended for constituting part of a full-sized female through hole (see FIG. 3B) for engagement with a corresponding male through hole (see FIG. 3A) of a neighbouring cuboid (not shown). The full-sized through holes 29 in the main surface 22 for engagement with a corresponding male through hole (see FIG. 3A) of a neighbouring cuboid (not shown).

The semi-sized female through holes 28 and the full-sized female through hole 29 has a support flange 30 extending along a circumference of the through holes 28,29. The support flange 30 is intended for limiting an axial extension of a ring-shaped seal (not shown) for sealing against an inner circumference of the female through holes 28,29 and against an outer circumference of a male through hole of another cuboid when the female through hole of one cuboid is engaging with a male through hole of neighbouring cuboid.

At selected corner positions of the side surfaces 23,24,25 protrusions 33 are provided. The protrusions 33 are intended for engaging with corresponding indentions at selected other corner positions of side surfaces of an opposite semi-sized cuboid (not shown) which the one semi-sized shown is to be attached to for forming a full-sized cuboid.

At selected corner positions of the side surfaces 23,24,26 indentions 14 are provided. The indentions 14 are intended for engaging with corresponding protrusions 13 at selected corner positions of side surfaces of an opposite semi-sized cuboid (not shown) which the one semi-sized shown is to be attached to for forming a full-sized cuboid.

Engagement between the protrusions 13 and the indentions 14 maintain two semi-sized cuboids in position in relation to each other to form a full-sized cuboid (see FIG. 6).

The semi-sized cuboid of the first type is possibly made from plastic such as PP, preferably with fibres, as example glass fibres, embedded within the PP. A thickness of the main surface and of the side surfaces is preferably between 2 mm and 10 mm, preferably between 2 mm and 5 mm. A length L1 of the one pair of opposing side edges of the main surface is possibly between 400 mm and 1000 mm. A length L2 of the one pair of opposing side edges of the main surface is possibly between 400 mm and 1000 mm. A length L3 of the side surface, in a direction perpendicular to the main surface is preferably between 200 mm and 500 mm. The semi-sized cuboid possibly has a volume within the main surface, inner sides of the side surfaces incl. plane areas which possible through holes expand of between 0.6 $m^3$ and 2 $m^3$, preferably between 0.5 $m^3$ and 1 $m^3$.

FIG. 6 shows a full-sized cuboid of the second type of cuboid, made from two semi-sized cuboids as shown in FIG. 4. The full-sized cuboid has two opposite main surfaces 22 each of which has a substantially circular through hole 29 and four side surfaces 23,24,25,26 each of which has a substantially circular through hole 28. In the figure, one through hole of one side surface 25 is closed by a cover (see FIG. 15) and another through hole of another side surface 24 is partly closed by a seal ring with a shroud (see FIG. 16).

The full-sized second type cuboid is intended as a water duct and/or a water retention module of the modular rain stormwater management system. In the embodiment shown, at least the side surfaces 23,24,25,26 are made as a sandwich structure. Each surface is constituted by opposing face plates 32,33 8 mutually connected by support ribs 34.

Thereby, rigidity of at least the side surfaces 23,24,25,26 and possibly also the main surfaces 22 is increased, better capable of withstanding load from the ground and from possible other cuboids positioned above the one cuboid, when the one cuboid together with other cuboids constitute the modular rain stormwater management system.

At each corner of the cuboid, locking recesses 35 are provided. The locking recesses 35 are intended for engaging with at least one locking pin of a corner locking part (see FIG. 24).

Figure 7A:
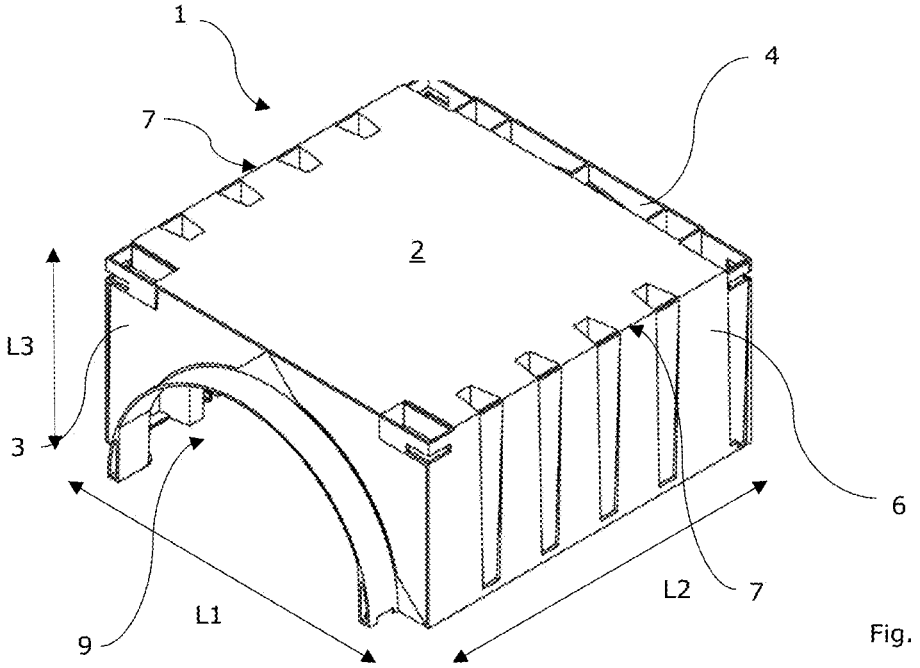
FIG. 7A and FIG. 7B are drawings of a preferred semi-sized first type of cuboid
Figure 7B:
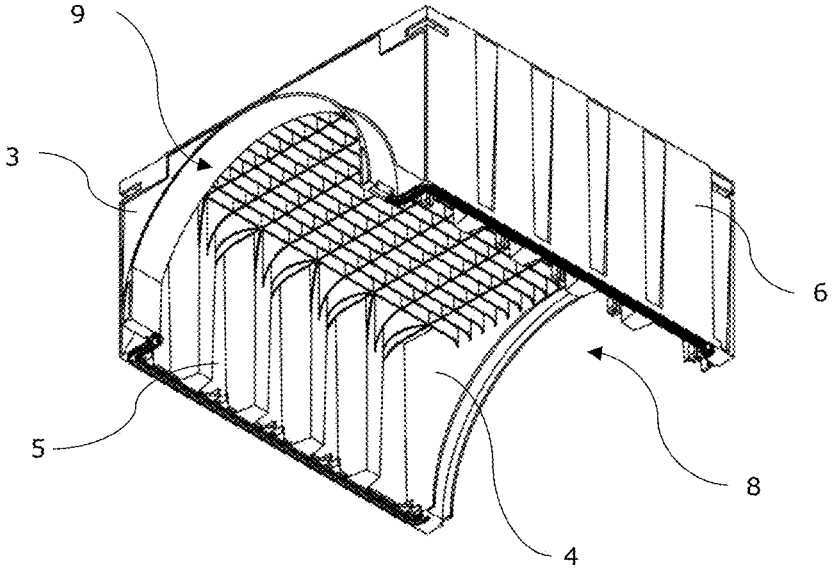

FIG. 7A and FIG. 7B shows a preferred embodiment of semi-sized cuboid for a first type 1 of cuboid. In the embodiment shown, the semi-sized cuboid has a main surface 2 and four side surfaces 3,4,5,6 extending from common boundaries 7 between the main surface 2 and the side surfaces 3,4,5,6. In the embodiment shown, two opposite side surfaces 3,4 have semi-sized through holes 8,9 in the shape of a semi-circle. Two other opposite side surfaces 5,6 are closed. The main surface 2 is closed.

One side surface 3 has a semi-sized through hole 8 intended for constituting part of a full-sized male through hole capable of engaging with a corresponding male through hole of a neighbouring cuboid (not shown). Another side surface 4 has a semi-sized through hole 9 constituting part of a full-sized female through hole capable of engaging with a corresponding female through hole of a neighbouring cuboid (not shown).

Figure 8A:
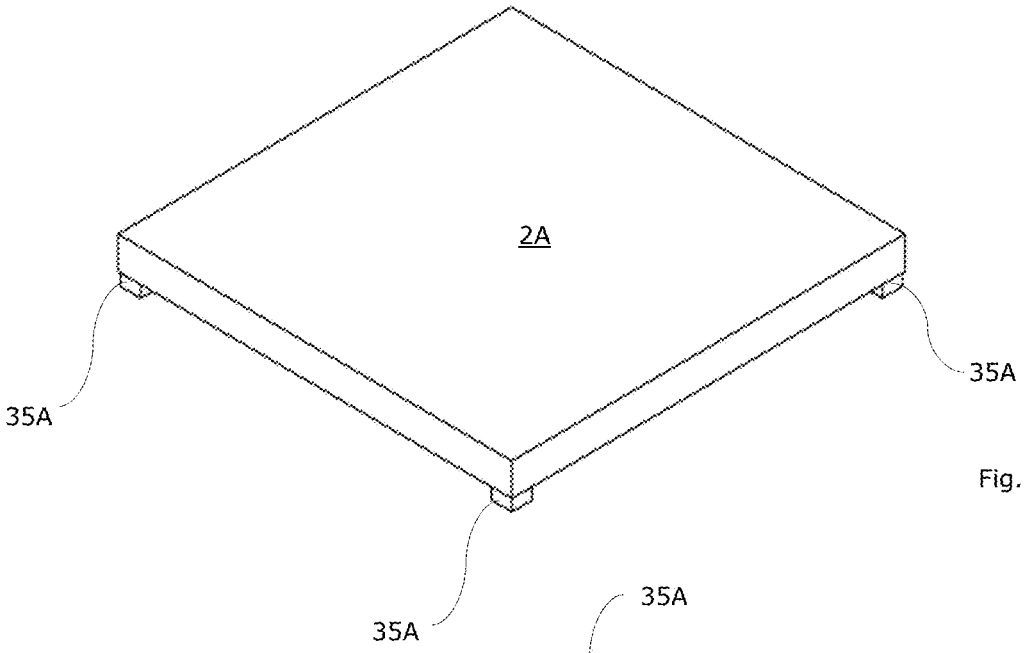
FIG. 8A and FIG. 8B are drawings of a main surface separate from side surfaces
Figure 8B:
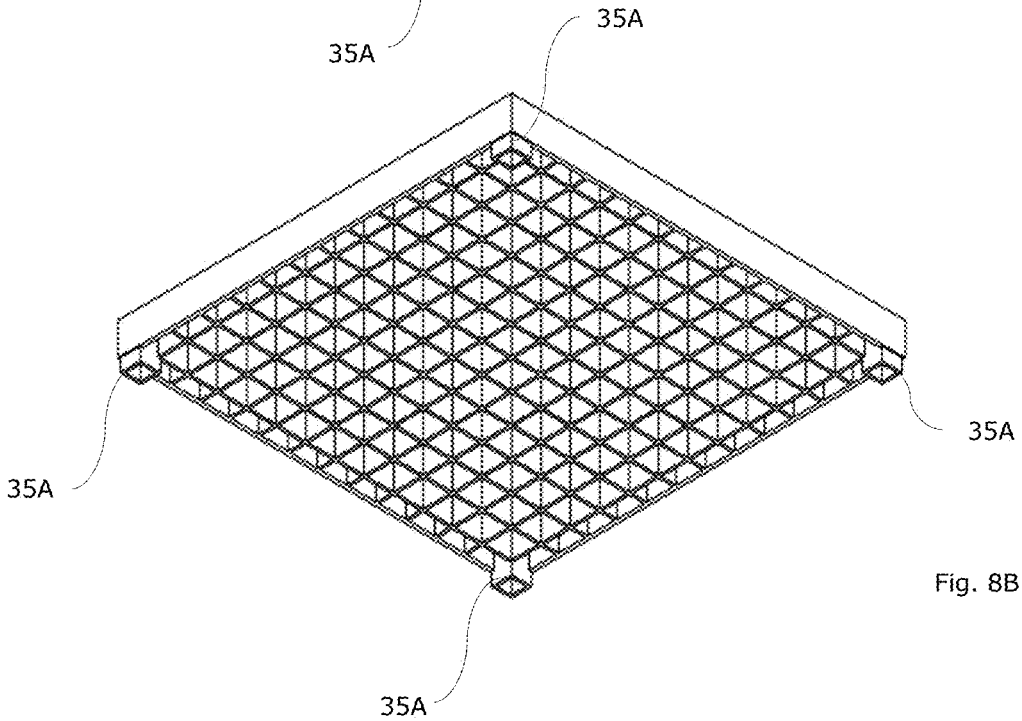

The preferred embodiment shown in FIG. 8A and FIG. 8B are has a plurality of specially manufactured integrate profiles such as internal and external ribs to increase stiffness of the cuboid. The possibility of manufacturing ribs, especially internal ribs, and if made of injection moulded plastic, and depending on the need for load carrying capability of the cuboid, is enhanced by manufacturing a cuboid form two semi-seized cuboid.

FIG. 8A and FIG. 8B shows a preferred embodiment of a semi-sized cuboid for the second type 21 of cuboid. In the embodiment shown, the semi-sized cuboid has a main surface 22 and four side surfaces 23,24,25,26 extending from edges 27 of the main surface 22. In the embodiment shown, all side surfaces 23,24,25,26 have semi-sized through holes 28 in the shape of a semi-circle. The main surface 22 has a full-sized through hole 29.

The semi-sized through holes 28 in the side surfaces 23,24,25,26 are intended for constituting part of a full-sized female through hole for engagement with a corresponding male through hole of a neighbouring cuboid (not shown). The full-sized through holes 29 in the main surface 22 for engagement with a corresponding male through hole of a neighbouring cuboid (not shown).

Figure 9A:
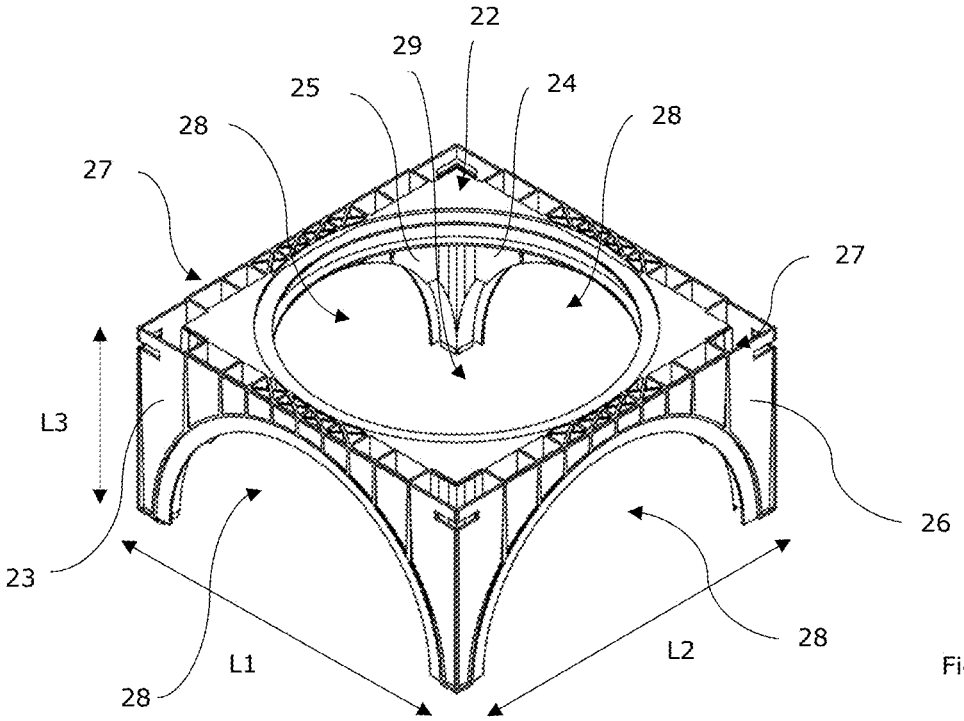
FIG. 9A and FIG. 9B are drawings of a possible semi-sized second type of cuboid
Figure 9B:
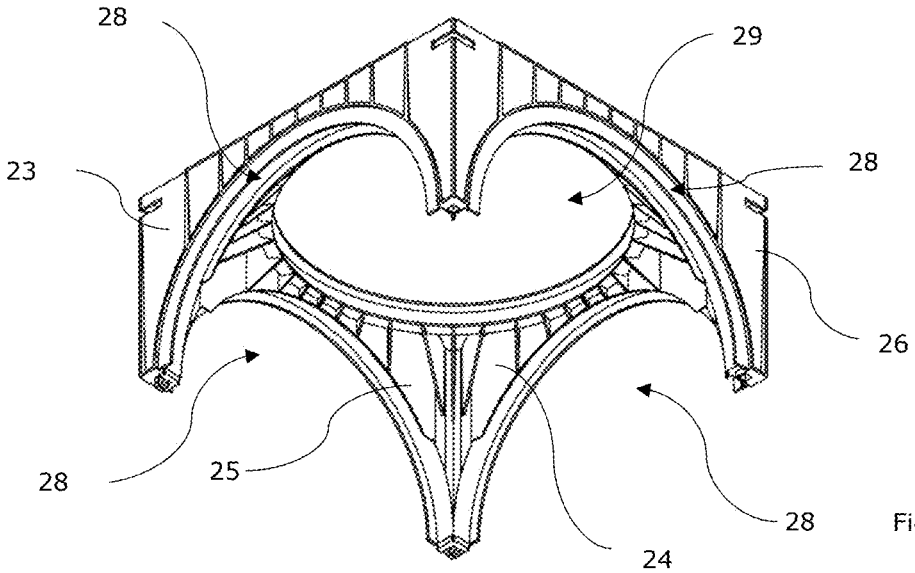

FIG. 9A and FIG. 9B shows a possible embodiment for at cuboid. The main surface 2 of the cuboid shown in FIG. 6 is provided with a main surface constituting a part 2A being separate from the side surfaces. The main surface 2A is provided with tenons 35A intended for being positioned in corresponding recesses 35 of a cuboid as shown in FIG. 6. Furthermore, the main surface 2A shown in FIG. 8A and FIG. 8B is provided with ribs for increasing the rigidity, and thereby the strength, of the main surface 2A.

Also, the possibility of manufacturing a main surface having a stiffness and a strength needed is enhances, when the main surface is aa part being separate from the side surfaces. Especially for cuboids intended for being uppermost cuboids in a module system from an underground stormwater retention basin are prone to the largest load form traffic on the ground. Cuboids being the uppermost cuboids may preferably be made with a main surface 2A being separate from the side surfaces in order to provide a main surface 2A having an utmost rigidity and strength towards load on the ground.

The main surface part 2*a* shown in FIG. 8A and FIG. 8B may also be provided for other cuboids as shown in FIG. 6. The cuboids shown in the other figures may also be amended so that the main surface is a part separate from the main surfaces. Furthermore, the separate part main surface 2A may be provided with a through holes, so that other parts (see FIG. 19-23) may be inserted into the separate part main surface 2A.

The preferred embodiment shown in FIG. 9A and FIG. 9B are has a plurality of specially manufactured integrate profiles such as internal and external ribs to increase stiffness of the cuboid. The possibility of manufacturing ribs, especially internal ribs, and if made of injection moulded plastic, and depending on the need for load carrying capability of the cuboid, is enhanced by manufacturing a cuboid form two semi-seized cuboid.

Figure 10:
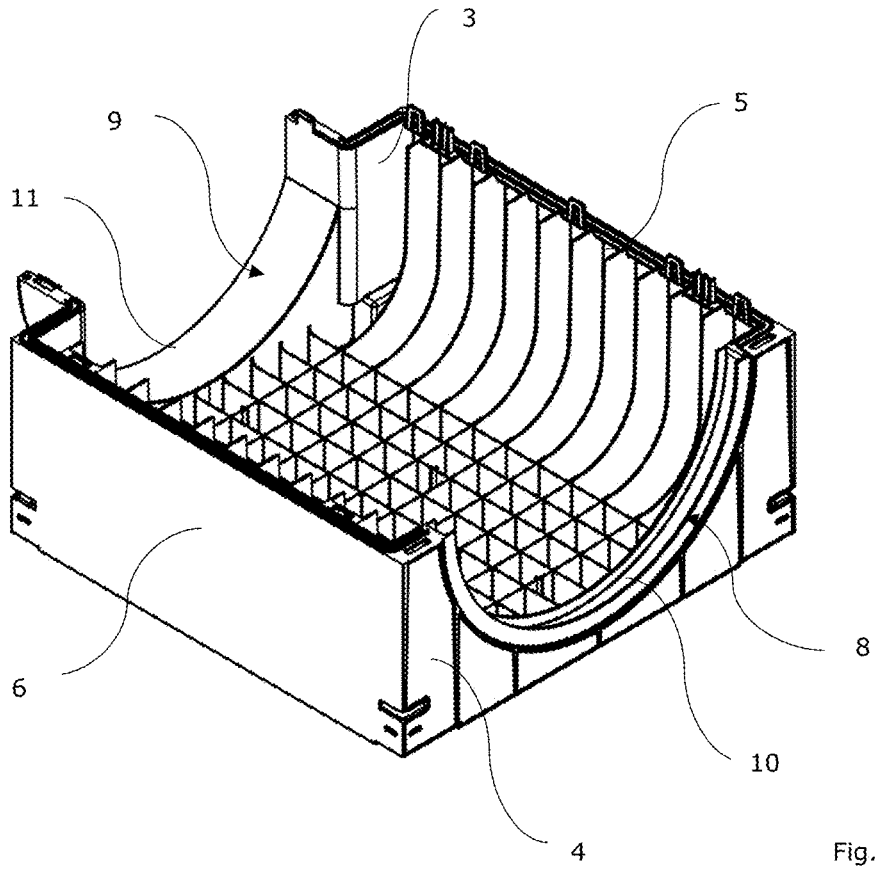
FIG. 10 is a drawing of one embodiment of a preferred semi-sized type of cuboid

FIG. 10 shows a preferred embodiment for at cuboid. The main surface 2 of the cuboid shown in FIG. 6 is provided with a main surface constituting a part 2A being separate from the side surfaces. The main surface 2A is provided with tenons 35A intended for being positioned in corresponding recesses 35 of a cuboid as shown in fig. Furthermore, the main surface 2A shown in FIG. 8A and FIG. 8B is provided with ribs for increasing the rigidity, and thereby the strength, of the main surface 2A.

Also, the possibility of manufacturing a main surface having a stiffness and a strength needed is enhances, when the main surface is aa part being separate from the side surfaces. Especially for cuboids intended for being uppermost cuboids in a module system from an underground stormwater retention basin are prone to the largest load form traffic on the ground. Cuboids being the uppermost cuboids may preferably be made with a main surface 2A being separate from the side surfaces in order to provide a main surface 2A having an utmost rigidity and strength towards load on the ground.

The preferred embodiment shown in FIG. 10 has a plurality of specially manufactured integrate profiles such as internal and external ribs to increase stiffness of the cuboid. The possibility of manufacturing ribs, especially internal ribs, and if made of injection moulded plastic, and depending on the need for load carrying capability of the cuboid, is enhanced by manufacturing a cuboid form two semi-seized cuboid.

Figure 11:
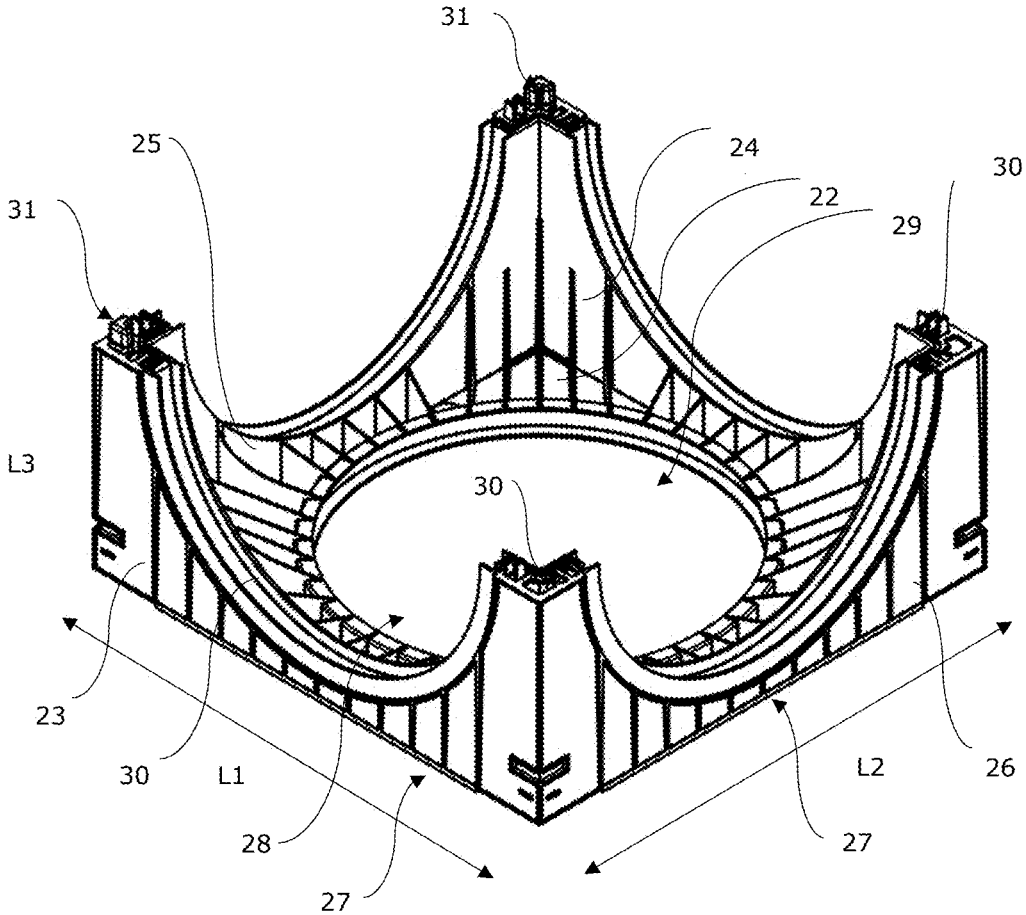
FIG. 11 is a drawing of another embodiment of a preferred semi-sized type of cuboid

FIG. 11 shows a preferred embodiment of semi-sized cuboid for a first type 1 of cuboid. In the embodiment shown, the semi-sized cuboid has a main surface 2 and four side surfaces 3,4,5,6 extending from common boundaries 7 between the main surface 2 and the side surfaces 3,4,5,6. In the embodiment shown, two opposite side surfaces 3,4 have semi-sized through holes 8,9 in the shape of a semi-circle. Two other opposite side surfaces 5,6 are closed. The main surface 2 is closed.

One side surface 3 has a semi-sized through hole 8 intended for constituting part of a full-sized male through hole capable of engaging with a corresponding male through hole of a neighbouring cuboid (not shown). Another side surface 4 has a semi-sized through hole 9 constituting part of a full-sized female through hole capable of engaging with a corresponding female through hole of a neighbouring cuboid (not shown).

The preferred embodiment shown in FIG. 8A and FIG. 8B are has a plurality of specially manufactured integrate profiles such as internal and external ribs to increase stiffness of the cuboid. The possibility of manufacturing ribs, especially internal ribs, and if made of injection moulded plastic, and depending on the need for load carrying capability of the cuboid, is enhanced by manufacturing a cuboid form two semi-seized cuboid.

FIG. 11 shows a possible embodiment for a cuboid. The main surface 2 of the cuboid shown in FIG. 6 is provided with a main surface constituting a part 2A being separate from the side surfaces. The main surface 2A is provided with tenons 35A intended for being positioned in corresponding recesses 35 of a cuboid as shown in FIG. 6. Furthermore, the main surface 2A shown in FIG. 8A and FIG. 8B is provided with ribs for increasing the rigidity, and thereby the strength, of the main surface 2A.

Also, the possibility of manufacturing a main surface having a stiffness and a strength needed is enhances, when the main surface is aa part being separate from the side surfaces. Especially for cuboids intended for being uppermost cuboids in a module system from an underground stormwater retention basin are prone to the largest load form traffic on the ground. Cuboids being the uppermost cuboids may preferably be made with a main surface 2A being separate from the side surfaces in order to provide a main surface 2A having an utmost rigidity and strength towards load on the ground.

The main surface part 2*a* shown in FIG. 8A and FIG. 8B may also be provided for other cuboids as shown in FIG. 6. The cuboids shown in the other figures may also be amended so that the main surface is a part separate from the main surfaces. Furthermore, the separate part main surface 2A may be provided with a through holes, so that other parts (see FIG. 19-23) may be inserted into the separate part main surface 2A.

The preferred embodiment shown in FIG. 9A and FIG. 9B are has a plurality of specially manufactured integrate profiles such as internal and external ribs to increase stiffness of the cuboid. The possibility of manufacturing ribs, especially internal ribs, and if made of injection moulded plastic, and depending on the need for load carrying capability of the cuboid, is enhanced by manufacturing a cuboid form two semi-seized cuboid.

In all embodiments of cuboids shown, any ribs provide for increased rigidity of the cuboid have the same thickness along the entire extension of the ribs. However, in alternative embodiments of the ribs, some of the ribs may be thicker than other of the ribs, depending on the position within the cuboid and depending on any requirement for increased stiffness of the cuboid at some positions relative to other positions.

Each of the ribs, or some of the ribs, may have an increased thickness at a base of the rib, proximate to where the rib extends from a main surface or a side surface, compared to at a tip of the rib, distant from where the rib extends from a main surface or a side surface, The stiffness provides by such rib may also be higher compare to ribs with the same thickness at the base as at the tip, and possibly, when manufacturing the cuboid by injection moulding, the cuboid may be easier to extract from the mould, if the ribs have a shape with a base of the rib having a larger thickness than the tip of the rib.

Figures 12A, 12B:
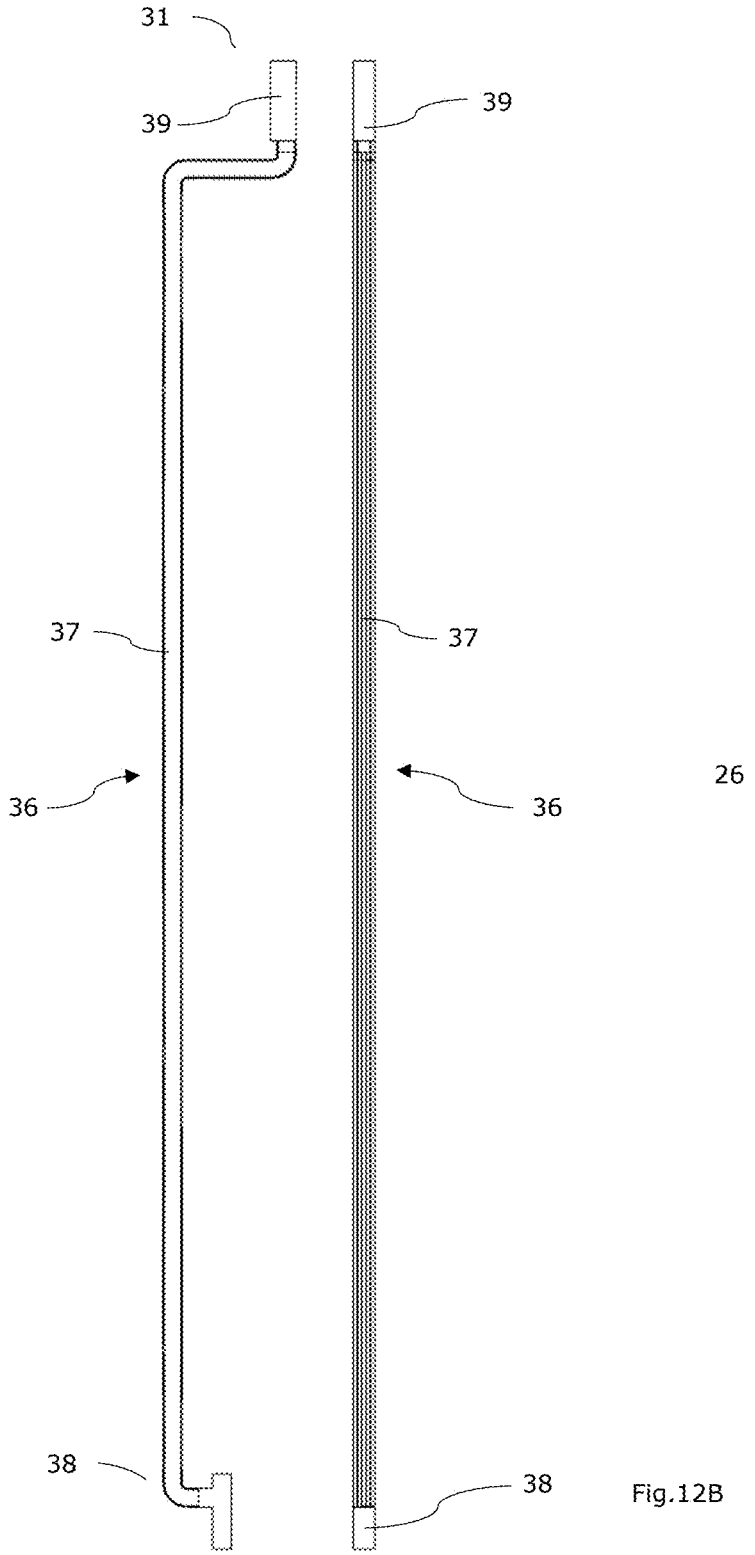
FIG. 12A and FIG. 12B are drawings of a longitudinal seal for a cuboid.

FIG. 12A and FIG. 12B show a possible embodiment of a longitudinal seal 36 for a first type of cuboid for providing watertight sealing between the bead 15 and the recess 16 (see FIG. 2) of two semi-sized first type cuboids, when two semi-sized first type cuboids are mutually engaged along the free edges for forming a full-sized first type cuboid.

The seal has a middle linear section 37 for inserting in a middle part of the recess 16 of a semi-sized first type cuboid (see FIG. 2). One end of the seal (lower end shown in FIG. 10A,10B) has one end section 38 with a geometrical shape corresponding to a part of the recess 16 extending along a female through hole 8 of a semi-sized first type cuboid (see FIG. 2). Another end of the seal (upper end shown in FIG. 10A,10B) has another end section 39 with a geometrical shape corresponding to a part of the recess 16 extending along a male through hole 9 of a first type semi-sized cuboid (see FIG. 2).

By providing end sections 38,39 of the seal, said end sections 38,39 corresponding to the shape of part of the recess along the female through hole and the male through hole, respectively, of a first type cuboid, a full-sized cuboid made from two semi-sized cuboids mutually joined and with a seal as shown in FIG. 10B, 10B is made watertight along the entire extension along the beads 15 and the recess 16 of the first type cuboid 1.

The ring-shaped seal (not shown), provided between an outer circumference of a male flange and an inner circumference of a female flange of two neighbouring cuboids mutually connected, makes the mutual connection of the flanges watertight. Together with the seal shown in FIG. 25A and FIG. 25B, semi-sized first type cuboids mutually connected and a connection between full-sized first type cuboids are made watertight. Thereby, the modular system is capable of detaining water for longer periods of time.

Figure 13:
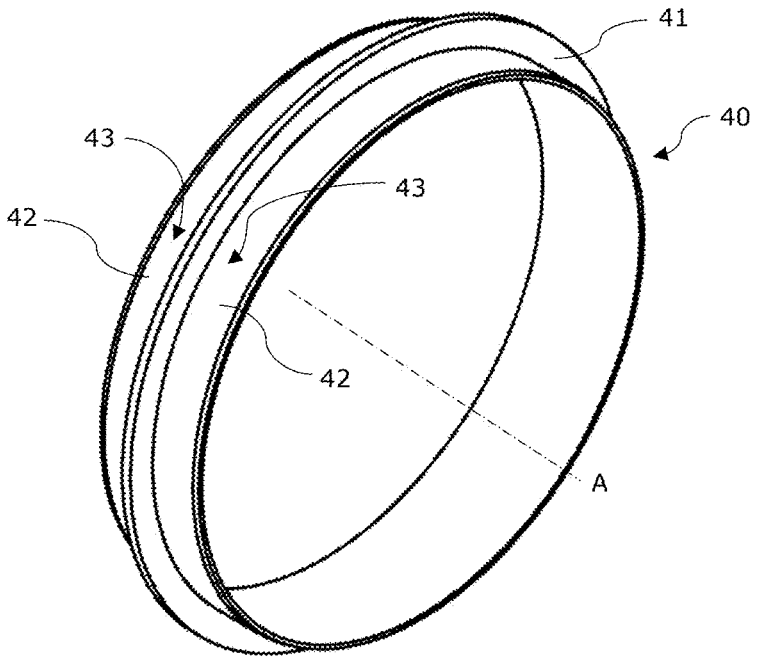
FIG. 13 is a drawing of one embodiment of a seal insert for two neighbouring cuboids.

FIG. 13 shows one embodiment of a seal insert 40 for providing a connection between female through holes of neighbouring cuboids of the second type cuboids. A rib 41 extend circumferentially along the seal insert 40 and extend radially outwards in relation to a centre axis A of the seal insert 40. The rib 41 is providing a stop limiting insertion of the seal insert 40 into the female through holes of neighbouring second type cuboids.

Male flanges 42 extend circumferentially along the seal insert 40 on each side of the rib 41 and extend along a longitudinal direction of the centre axis A of the seal inert 40. The flanges 42 are dimensioned so that the flanges 42 extend a certain distance, preferably between 10 mmm and 50 mm, into female through holes when the seal insert 40 is engaging with the female through holes of neighbouring second type cuboids.

An outer diameter of the male flange 42 is preferably 500 mm, which is the same diameter as an outer diameter of one of a plurality of standard sized drain pipes. Another diameter of the male flange 42 may be selected, possibly being the same diameter as an outer diameter of another one of a plurality of standard sized drain pipes.

Each of the flanges 42 has a recess 43. Each of the recess 43 are intended for holding a ring-shaped seal (not shown) for sealing against an outer circumference of one of the recess 43 and against inner circumferences of female through holes of cuboids when the flanges 42 engage with female through holes of the cuboids.

FIG. 12 shows another embodiment of a seal insert 44 for insertion into a female through hole of either one of a first type of cuboid or of a second type of cuboid. An end rib 45 extend circumferentially along the seal insert 44 and extend radially outwards in relation to a centre axis A of the seal insert 44. The end rib 45 is providing a stop limiting insertion of the seal insert 44 into the female through hole of a cuboid.

A male flange 46 extends circumferentially along the seal insert 44 on one side of the end rib 45 and extend along a longitudinal direction of the centre axis A of the seal insert 50. The flange 46 is dimensioned so that the flange of the seal insert 44 extends a certain distance, preferably between 10 mmm and 50 mm, into a female through hole of the cuboid when the flange 46 is engaging with the female through hole.

The flange has a recess 47. The recess 47 is intended for holding a ring-shaped seal (not shown) for sealing against an outer circumference of the recess 47 and against an inner circumference of a female through hole of a cuboid when the flange 46 is engaging with a female through hole of the cuboid.

Figure 15:
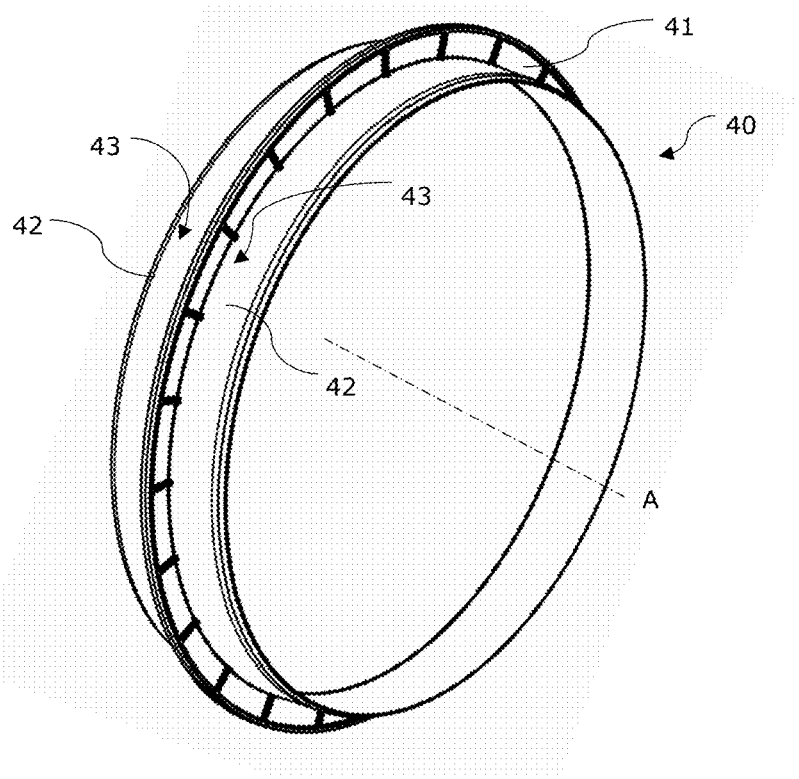
FIG. 15 is a drawing of yet another embodiment of a seal insert for neighbouring cuboids.

FIG. 15 shows one embodiment of a seal insert 40 for providing a connection between female through holes of neighbouring cuboids of the second type cuboids. A rib 41 extend circumferentially along the seal insert 40 and extend radially outwards in relation to a centre axis A of the seal insert 40. The rib 41 is providing a stop limiting insertion of the seal insert 40 into the female through holes of neighbouring second type cuboids.

Male flanges 42 extend circumferentially along the seal insert 40 on each side of the rib 41 and extend along a longitudinal direction of the centre axis A of the seal inert 40. The flanges 42 are dimensioned so that the flanges 42 extend a certain distance, preferably between 10 mm and 50 mm, into female through holes when the seal insert 40 is engaging with the female through holes of neighbouring second type cuboids.

Each of the flanges 42 has a recess 43. Each of the recess 43 are intended for holding a ring-shaped seal (not shown) for sealing against an outer circumference of one of the recess 43 and against inner circumferences of female through holes of cuboids when the flanges 42 is engaging with female through holes of the cuboids.

An outer diameter of the male flange 42 is preferably 500 mm, which is the same diameter as an outer diameter of one of a plurality of standard sized drain pipes. Another diameter of the male flange 42 may be selected, possibly being the same diameter as an outer diameter of another one of a plurality of standard sized drain pipes.

The insert 44 shown in FIG. 15 is closed so that water and all other materials in the one cuboid, which the seal inert 44 is inserted into, is prevented from passing to a neighbouring cuboid whish the seal inert 44 also is inserted into, and vice versa.

The insert 44 shown in FIG. 15 may be used, during building of the modular system, to shut off one part of the modular system from another part of the modular system, either one part at one level of the system from another part at the same level of the system, or one part at one level of the system from another part at a lower or higher level of the system.

Figure 16:
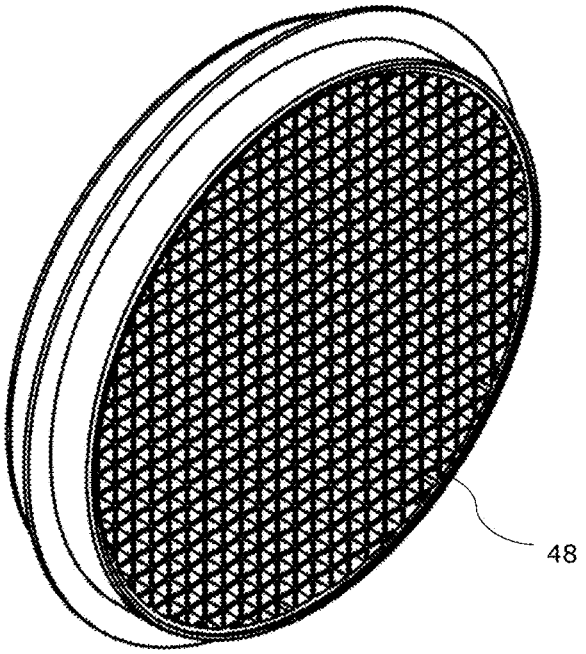
FIG. 16 is a drawing of the one embodiment seal insert and with a grate inserted.

FIG. 16 shows a seal insert 40 as shown in FIG. 11 and with a grate 48 inserted into the seal insert 40. Water passing from one cuboid to another neighbouring cuboid, both of which are mutually connected by the seal insert 40, has to pass the grate 48. The grate 48 may be a mechanical grate, a grate with a biological filter or a grate with a chemical filter, depending on the needs for filtering water passing from the one cuboid to the neighbouring cuboid.

Figure 17:
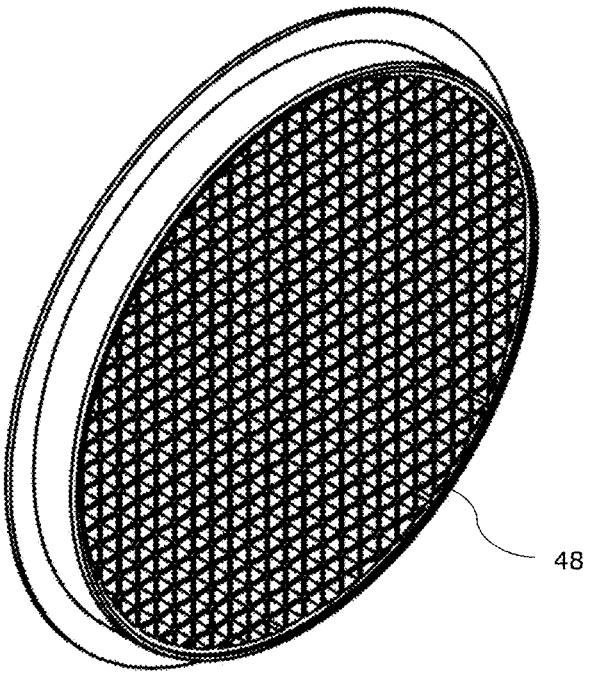
FIG. 17 is a drawing of the other embodiment seal insert and with a grate inserted.

FIG. 17 shows a seal insert 44 as shown in FIG. 12 and with a grate 48 inserted into the seal insert 44. Water passing from a cuboid to an exterior of the cuboid has to pass the grate 48. The grate 48 may be a mechanical grate, a grate with a biological filter or a grate with a chemical filter, depending on the needs for filtering water passing from the cuboid to the exterior.

The seal insert 44 with the grate 48 as shown in FIG. 16 may be intended for allowing water inside the cuboid to pass to the exterior of a cuboid, possibly into the soil in which the modular system is buried or for allowing water outside the cuboid to pass into the interior of a cuboid, possibly from a road or pedestrian surface above the cuboid.

The seal insert 44 with the grate 48 as shown in FIG. 16 may also be intended for both allowing water from inside the cuboid to pass to the exterior of the cuboid and allowing water from outside the cuboid to pass into the interior of the cuboid.

Figure 14:
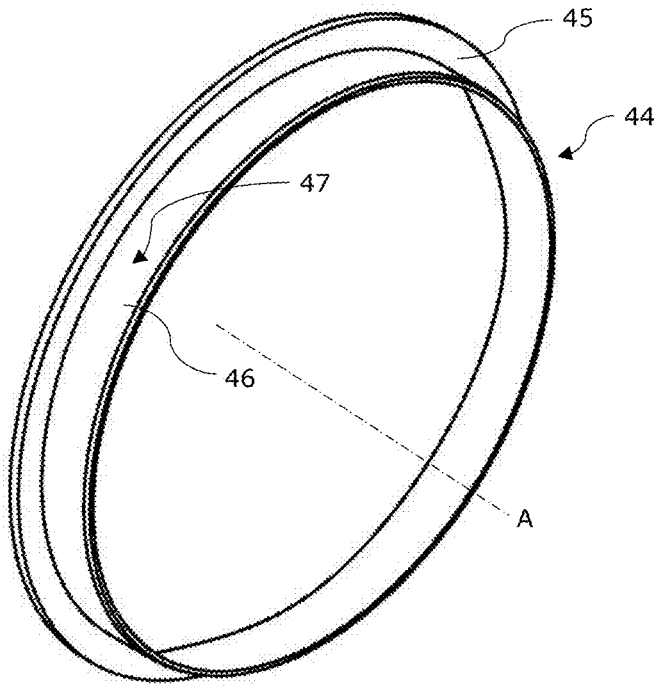
FIG. 14 is a drawing of another embodiment of a seal insert for a single cuboid.

The seal insert 44 with the grate 48 as shown in FIG. 14 is preferably used in through holes of cuboids positioned at bottom surfaces and/or side surfaces of cuboids positioned lowermost in the modular system for rain stormwater management at positions where water is capable of being passed to the outside surroundings. The outside surrounding may be large rocks or stones, where voids between the rocks or stones are intended for retaining water from one or more lowermost cuboids of the modular structure.

Figure 18:
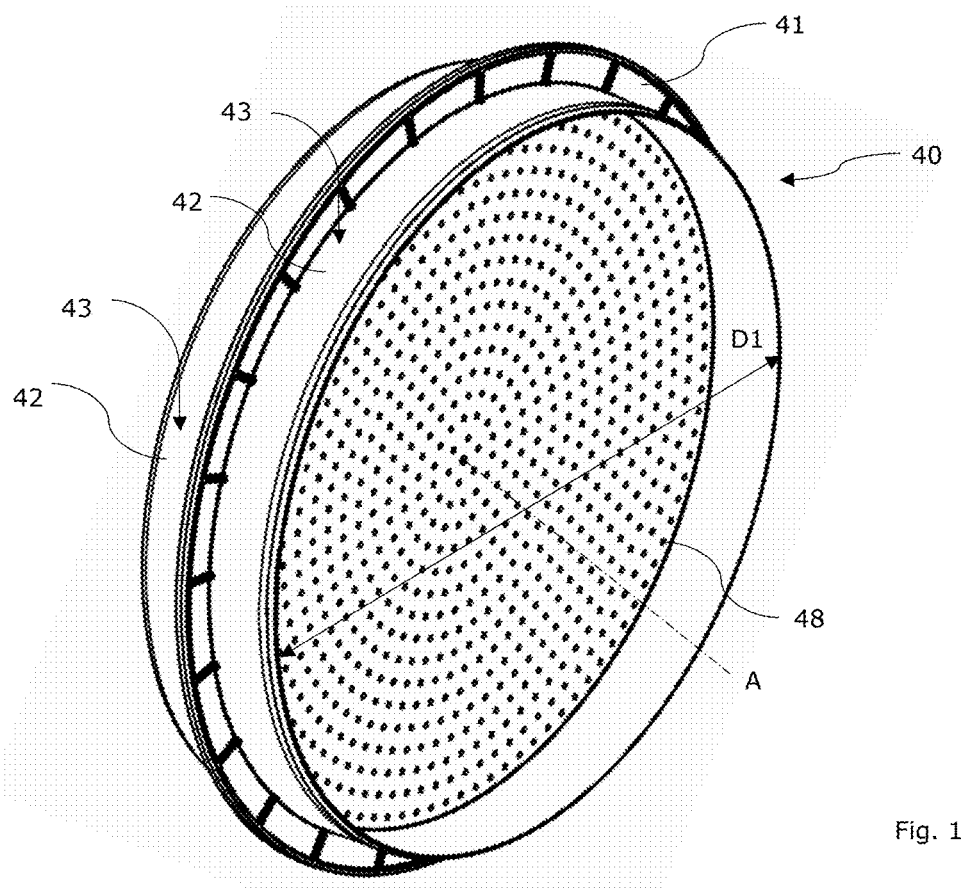
FIG. 18 is a drawing of one cover for a female through hole of a cuboid.

FIG. 18 shows another embodiment of a seal insert 40 for providing a connection between female through holes of neighbouring cuboids of the second type cuboids. A rib 41 extend circumferentially along the seal insert 40 and extend radially outwards in relation to a centre axis A of the seal insert 40. The rib 41 is providing a stop limiting insertion of the seal insert 40 into the female through holes of neighbouring second type cuboids.

Male flanges 42 extend circumferentially along the seal insert 40 on each side of the rib 41 and extend along a longitudinal direction of the centre axis A of the seal inert 40. The flanges 42 are dimensioned so that the flanges 42 extend a certain distance, preferably between 10 mm and 50 mm, into female through holes when the seal insert 40 is engaging with the female through holes of neighbouring second type cuboids.

Each of the flanges 42 has a recess 43. Each of the recesses 43 are intended for holding a ring-shaped seal (not shown) for sealing against an outer circumference of one of the recesses 43 and against inner circumferences of female through holes of cuboids when the flanges 42 are engaging with female through holes of the cuboids.

The seal insert 40 has a grate 48 constituting an integrate part of the seal insert 40. The grate is made up by perforations 48 in a surface extending within the extension of the rib 41. Water passing from one cuboid to another neighbouring cuboid, both of which are mutually connected by the seal insert 40, has to pass the grate 48. The grate 48 is a mechanical grate but may be supplemented by a biological filter or a chemical filter, depending on any needs for filtering water passing from the one cuboid to the neighbouring cuboid or passing from a cuboid to surroundings outside the cuboid.

An outer diameter of the male flange 42 is preferably 500 mm, which is the same diameter as an outer diameter of one of a plurality of standard sized drain pipes. Another diameter of the male flange 42 may be selected, possibly being the same diameter as an outer diameter of another one of a plurality of standard sized drain pipes.

The part 44 as shown in FIG. 18 may be intended for allowing water inside the cuboid to pass to the exterior of a cuboid, possibly into the soil in which the modular system is buried or for allowing water outside the cuboid to pass into the interior of a cuboid, possibly from a road or pedestrian surface above the cuboid. The part 44 may also be intended for both allowing water from inside the cuboid to pass to the exterior of the cuboid and allowing water from outside the cuboid to pass into the interior of the cuboid.

Figure 19:
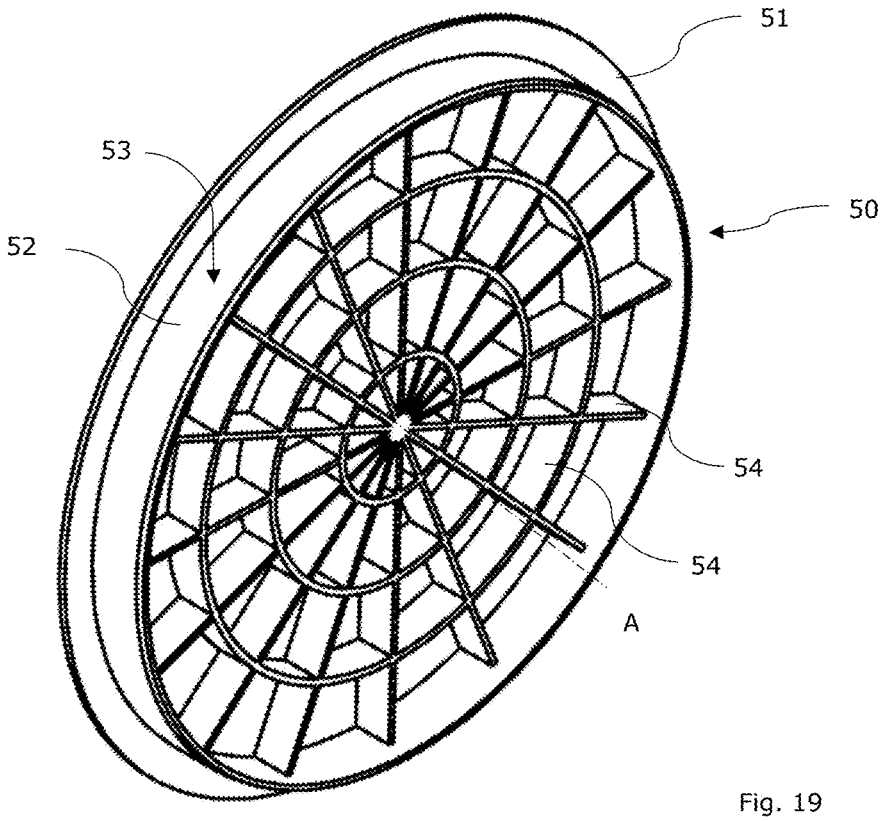
FIG. 19 is a drawing of another cover for a female through hole of a cuboid.

FIG. 19 shows a cover 50 for a female through hole of a cuboid. The cover 50 is intended for covering a female through hole towards an exterior of the cuboid, possibly soil into which the cuboid is buried or possibly a road or pedestrian surface above the cuboid.

An end rib 51 extend circumferentially along the cover 50 and extend outwards in relation to a longitudinal axis A of the cover 50. The end rib 51 is intended for providing a stop limiting insertion of the cover 50 into the female through hole of a cuboid.

A male flange 52 extends circumferentially along the cover 50 on one side of the end rib 41 and extend along a longitudinal direction of the centre axis A of the cover. The flange 52 is dimensioned so that the flange 62 extends a certain distance, preferably between 10 mm and 50 mm, into a female through hole of the cuboid when the flange 52 is engaging with the female through hole.

The flange has a recess 53. The recess 53 is intended for holding a ring-shaped seal (not shown) for sealing against an outer circumference of the recess 53 and against an inner circumference of a female through hole of a cuboid when the flange 52 is engaging with a female through hole of the cuboid.

An inside surface of the cover 50, intended for facing an interior of a cuboid, is provided with ribs 54 extending radially and circumferentially. The ribs 54 assist in the cover being capable of withstanding forces acting on the cover from the exterior.

Figure 20A:
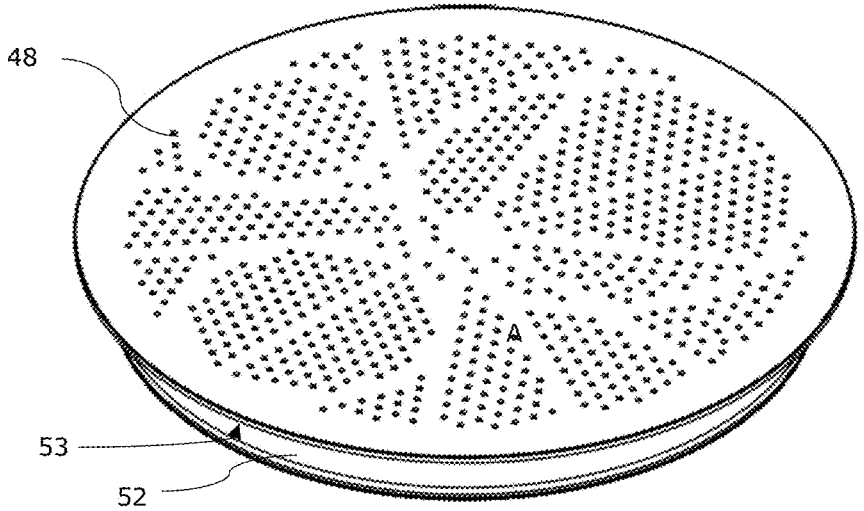
FIG. 20A and FIG. 20B are drawings of yet another cover for a female through hole of a cuboid.
Figure 20B:
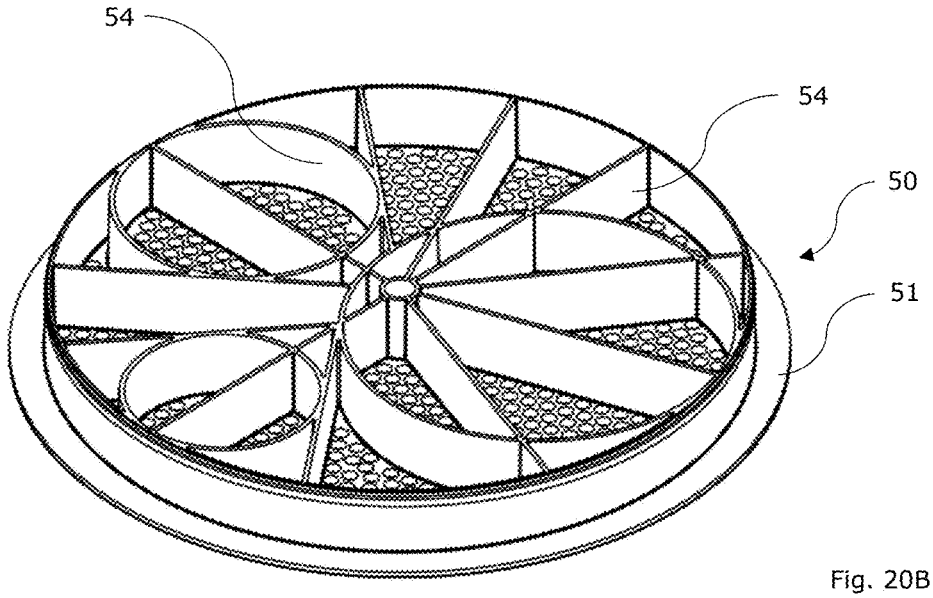

FIG. 20A and FIG. 20B shows a cover 50 for a female through hole of a cuboid. The cover 50 is intended for covering a female through hole towards an exterior of the cuboid, possibly soil into which the cuboid is buried or possibly a road or pedestrian surface above the cuboid.

An end rib 51 extend circumferentially along the cover 50 and extend outwards in relation to a longitudinal axis A of the cover 50. The end rib 51 is intended for providing a stop limiting insertion of the cover 50 into the female through hole of a cuboid.

A male flange 52 extends circumferentially along the cover 50 on one side of the end rib 41 and extend along a longitudinal direction of the centre axis A of the cover. The flange 52 is dimensioned so that the flange 62 extends a certain distance, preferably between 10 mm and 50 mm, into a female through hole of the cuboid when the flange 52 is engaging with the female through hole.

The flange has a recess 53. The recess 53 is intended for holding a ring-shaped seal (not shown) for sealing against an outer circumference of the recess 53 and against an inner circumference of a female through hole of a cuboid when the flange 52 is engaging with a female through hole of the cuboid.

An inside surface of the cover 50, intended for facing an interior of a cuboid, is provided with ribs 54 extending radially and circumferentially. The ribs 54 assist in the cover being capable of withstanding forces acting on the cover from the exterior.

In the embodiment shown, some of the ribs 54 have a circular shape, each with various diameters. The various diameters of the circular ribs correspond to diameters of standard sized drain pipes. Standard sizes often used for drain pipes have outer diameters of a little larger than either 110 mm, 160 mm or 250 mm. Accordingly, inner diameters of the three circular ribs shown are suited for having standard sized pips with an outer diameter of either 110 mm, 160 mm or 250 mm attached to the cover. If needed, a drain pipe of standard diameter may be fitted into the cover by cutting away, possibly by an electrical jigsaw, part of the cover within boundaries of the circular rib 54 having the size corresponding to the diameter of the drain pipe to be fitted.

In the embodiment shown in FIG. 20A and FIG. 20B the cover is provided with perforations. The perforations are intended for allowing water escaping the cuboid.

An outer diameter of the male flange 52 is preferably 500 mm, which is the same diameter as an outer diameter of one of a plurality of standard sized drain pipes. Another diameter of the male flange 52 may be selected, possibly being the same diameter as an outer diameter of another one of a plurality of standard sized drain pipes.

Figure 21A:
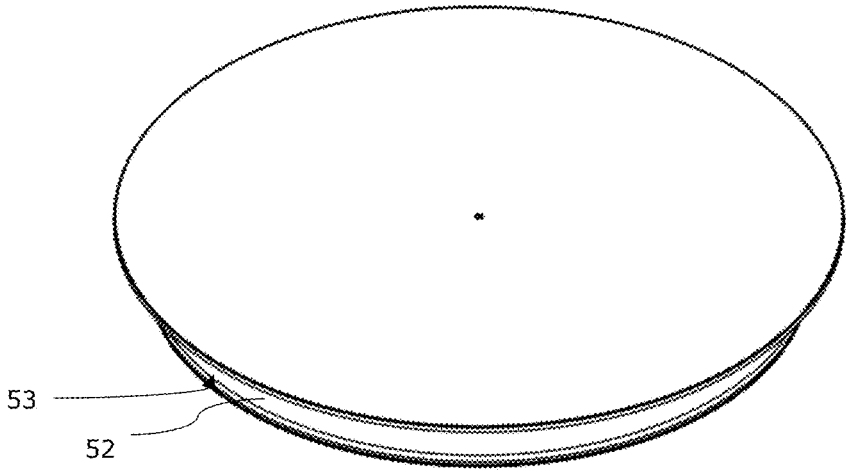
FIG. 21A and FIG. 21B are drawings of still another cover for a female through hole of a cuboid.
Figure 21B:
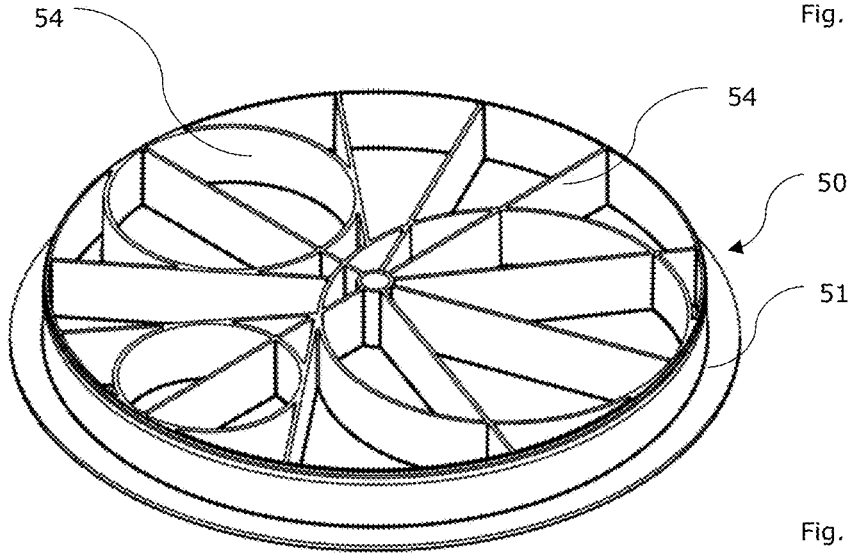

FIG. 21A and FIG. 21B shows a cover 50 for a female through hole of a cuboid. The cover 50 is intended for covering a female through hole towards an exterior of the cuboid, possibly soil into which the cuboid is buried or possibly a road or pedestrian surface above the cuboid.

An end rib 51 extend circumferentially along the cover 50 and extend outwards in relation to a longitudinal axis A of the cover 50. The end rib 51 is intended for providing a stop limiting insertion of the cover 50 into the female through hole of a cuboid.

A male flange 52 extends circumferentially along the cover 50 on one side of the end rib 41 and extend along a longitudinal direction of the centre axis A of the cover. The flange 52 is dimensioned so that the flange 62 extends a certain distance, preferably between 10 mm and 50 mm, into a female through hole of the cuboid when the flange 52 is engaging with the female through hole.

The flange has a recess 53. The recess 53 is intended for holding a ring-shaped seal (not shown) for sealing against an outer circumference of the recess 53 and against an inner circumference of a female through hole of a cuboid when the flange 52 is engaging with a female through hole of the cuboid.

An inside surface of the cover 50, intended for facing an interior of a cuboid, is provided with ribs 54 extending radially and circumferentially. The ribs 54 assist in the cover being capable of withstanding forces acting on the cover from the exterior.

In the embodiment shown in FIG. 21A and FIG. 21B, the cover is not provided with perforations, the cover thereby preventing water from escaping the cuboid.

An outer diameter of the male flange 52 is preferably 500 mm, which is the same diameter as an outer diameter of one of a plurality of standard sized drain pipes. Another diameter of the male flange 52 may be selected, possibly being the same diameter as an outer diameter of another one of a plurality of standard sized drain pipes.

Figure 22:
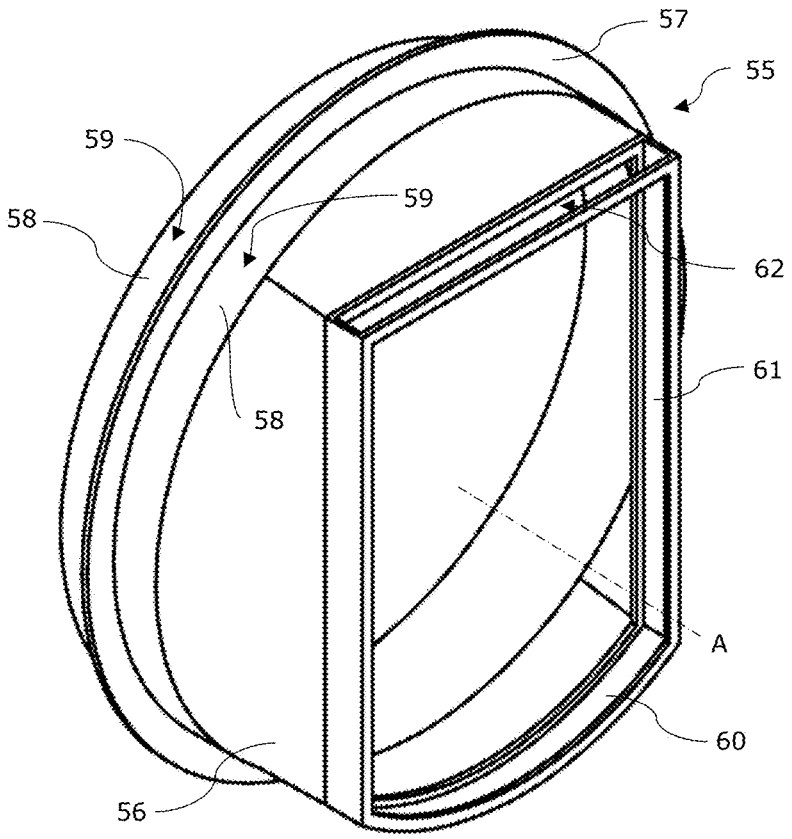
FIG. 22 is a drawing of yet another embodiment of a seal insert for cuboids.

FIG. 22 shows yet another embodiment of a seal insert 55. The yet other embodiment of a seal insert 55 has a shroud 56 for a grate or a screen (see FIG. 18 and FIG. 19).

The seal insert 55 with shroud 56 has a circular centre rib 57. The centre rib 56 extends circumferentially along the seal insert 55. The centre rib 57 is providing a stop limiting insertion of the seal insert 55 into female through holes of neighbouring cuboids.

Male flanges 58 of the seal insert 55 extend circumferentially along the seal insert 55 on each side of the centre rib 57. The flanges 58 are dimensioned so that the flanges of the seal insert 55 extend a certain distance, preferably between 10 mm and 50 mm, into female through holes of the neighbouring cuboids when the seal insert 55 is engaging with the female through holes.

The shroud 56 of the seal insert 55 extends in extension of the one flange 58. The shroud 58 extends from the one flange 58 to an opening 59 of the shroud.

In the embodiment shown, the opening 59 of the shroud 56 is rectangular apart from a bottom edge 60 shaped as part of circle and with a circumference corresponding to part of the circumference of an entire circular hole through the seal insert 55. The opening 59 of the shroud 56 has side tracks 61 and a top track 62 for guiding and holding a grate or a screen (see FIG. 18 and FIG. 19) in the opening 59 of the shroud 36.

An outer diameter of the male flange 52 is preferably 500 mm, which is the same diameter as an outer diameter of one of a plurality of standard sized drain pipes. Another diameter of the male flange 52 may be selected, possibly being the same diameter as an outer diameter of another one of a plurality of standard sized drain pipes.

Figure 23:
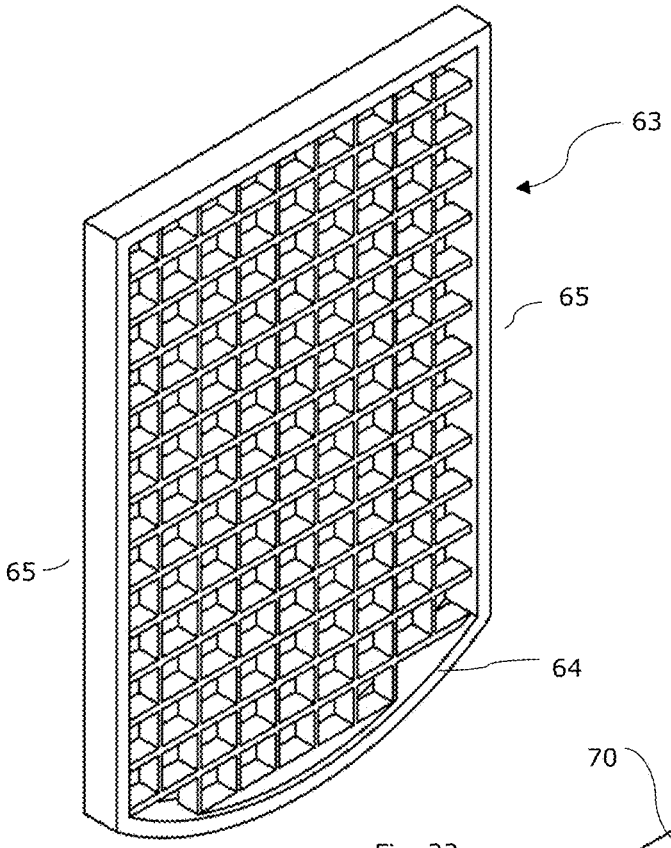
FIG. 23 is a drawing of a grate insert for the yet other embodiment of a seal insert.

FIG. 23 shows a grate insert 63 with an outer shape corresponding to the opening of the shroud 54 shown in FIG. 16. The grate insert 63 has a bottom edge 64 for engaging with the bottom edge 60 of the shroud 56 shown in FIG. 16, side edges 65 for engaging with the side tracks 61 of the shroud 56 shown in FIG. 16 and a top edge 66 for engaging with the top track 62 of the shroud 56 shown in FIG. 16.

Water is allowed passing from one cuboid to another neighbouring cuboid, both of which are mutually connected by the seal insert with shroud, has to pass the grate. The grate may be a mechanical grate, a grate with a biological filter or a grate with a chemical filter, depending on the needs for filtering water passing from the one cuboid to the neighbouring cuboid.

Figure 24:
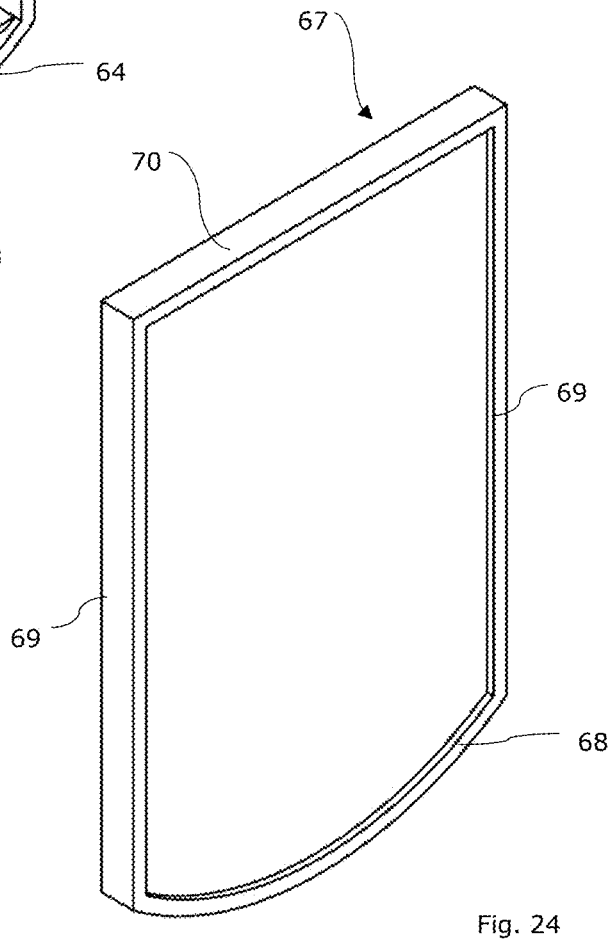
FIG. 24 is a drawing of a screen insert for the yet other embodiment of a seal insert.

FIG. 24 shows a screen insert 67 with an outer shape corresponding to the opening of the shroud 56 shown in FIG. 16. The screen insert 63 has a bottom edge 68 for engaging with the bottom edge 60 of the shroud 56 shown in FIG. 16, side edges 69 for engaging with the side tracks 61 of the shroud 56 shown in FIG. 16 and a top edge 70 for engaging with the top track 62 of the shroud 56 shown in FIG. 16.

Water is prevented from passing from one cuboid to another neighbouring cuboid, both of which are mutually connected by the seal insert with shroud. In the embodiment, the screen is entirely closed within the entire circumference of the screen, providing a full prevention of water passing.

In an alternative embodiment, the screen is only partly closed within the circumference of the screen, partly allowed water passing from one cuboid to another neighbouring cuboid, both of which are mutually connected by the seal insert with shroud.

One example is that an upper part of the screen is not closed. Water in the cuboid, at a level above the not-closed upper part of the screen, is allowed passing from one cuboid to another neighbouring cuboid, both of which are mutually connected by the seal insert with shroud. Water at a level below the not-closed upper part of the screen, is prevented from passing from the one cuboid to the other neighbouring cuboid.

Possible debris in water and with a density higher than the water may thereby be prevented by the screen from passing from one cuboid to another neighbouring cuboid, both of which are mutually connected by the seal insert with shroud, while water is still allowed passing form the one cuboid to the other neighbouring cuboid.

Another example is that a lower part of the screen is not closed. Water in the cuboid, at a level below the not-closed lower part of the screen, is allowed passing from one cuboid to another neighbouring cuboid, both of which are mutually connected by the seal insert with shroud. Water at a level above the not-closed lower part of the screen is prevented from passing from the one cuboid to the other neighbouring cuboid.

Possible debris in water and with a density higher than the water may thereby be prevented by the screen from passing from one cuboid to another neighbouring cuboid, both of which are mutually connected by the seal insert with shroud, while water is still allowed passing from the one cuboid to the other neighbouring cuboid.

Yet another example is that a centre part of the screen is not closed. Water in the cuboid, at a centre level between an upper part of the screen and a lower part of the screen, is allowed passing from one cuboid to another neighbouring cuboid, both of which are mutually connected by the seal insert with shroud.

Both water at a level below the not-closed centre part of the screen, and possibly holding debris with a density higher than water, and water at a level above the not-closed centre part of the screen, and possibly holding debris with a density lower than water, is prevented from passing from the one cuboid to the other neighbouring cuboid, while water is still allowed passing from the one cuboid to the other neighbouring cuboid.

Figure 25:
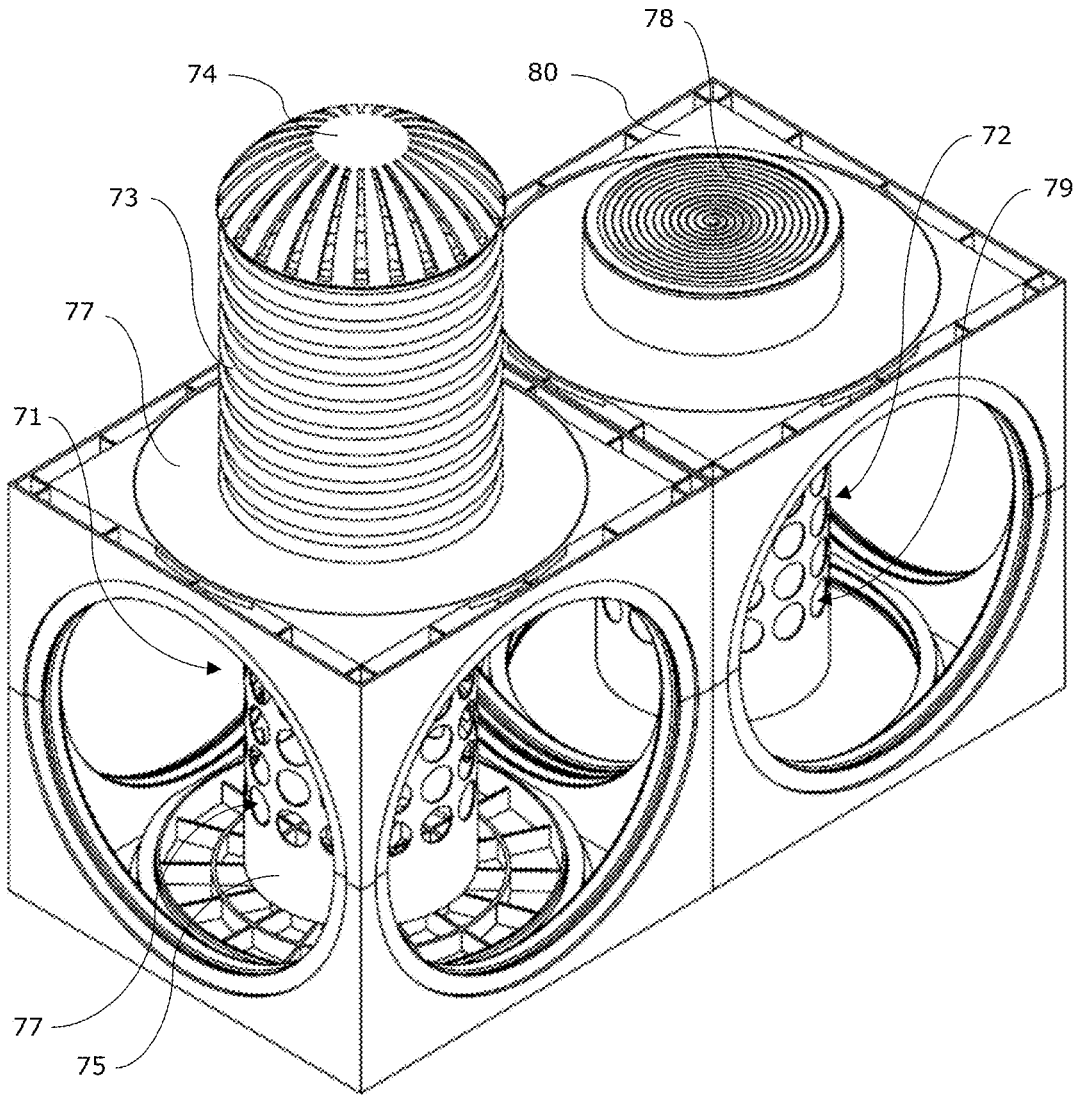
FIG. 25 is a drawing of a bucket insert and a wick insert for the modular system.

FIG. 25 shows two possible inserts for the modular system. One insert shown to the left is a bucket insert 71. Another insert, shown to the right, is a wick insert 72.

The bucket insert 71 is intended for collecting debris possibly being passed from ground level to a cuboid of the modular system in which the bucket insert is inserted. A pipe 73 has a top grate 74 intended for being placed at ground level, preventing larger debris from passing to the cuboids of the modular system. The pipe 73 leads from the grate 74 to a bucket 75. The bucket 75 is supported by at a bottom of the bucket 75 by a cover 50 (see FIG. 16) in a bottom through hole of the cuboid, where the bucket 75 is inserted.

Perforations 76 are provided along a side surface of the bucket 75. The perforations 76 allow water to pass from inside the bucket to outside the bucket and into the cuboid where the bucket 75 is inserted. The bottom of the bucket is not provided with perforations and is intended for collecting any debris, which may have passed the grate 74. The bucket 75 may be lifted out of the cuboid by removing the grate 74, attaching a gripping tool (not shown) to the bucket 75 and lifting the bucket 75 out of the cuboid along the pipe 73. The pipe 73 is supported by a support ring 77 (see FIG. 20 and FIG. 21) placed an upper surface of the cuboid.

The wick insert 72 is intended for passing water possible passing or being retained or being contained in the cuboid, where wick material 78 is inserted, and to a top surface of the wick material. Perforations 79 are provided along a side surface of the wick insert 72. The perforations 79 allow water to pass from inside the cuboid where the wick insert 72 is inserted and to the wick material 78. The wick material may, as example, be . . .

A plant such as grass, bushes or a tree may be planted in soil above the wick material. The soil is provided between the ground and the top of the cuboid, where the wick material is inserted. Because of perforations of the wick insert, and because of the wick material, any water in the cuboid may be passed from the cuboid, through the perforations, along the wick material 78, to the soil above the cuboid and from the soil to the plant planted in the soil. The wick insert 72 is supported by a support ring 79 similar to the support ring 77 for the bucket insert 71.

Figure 26A:
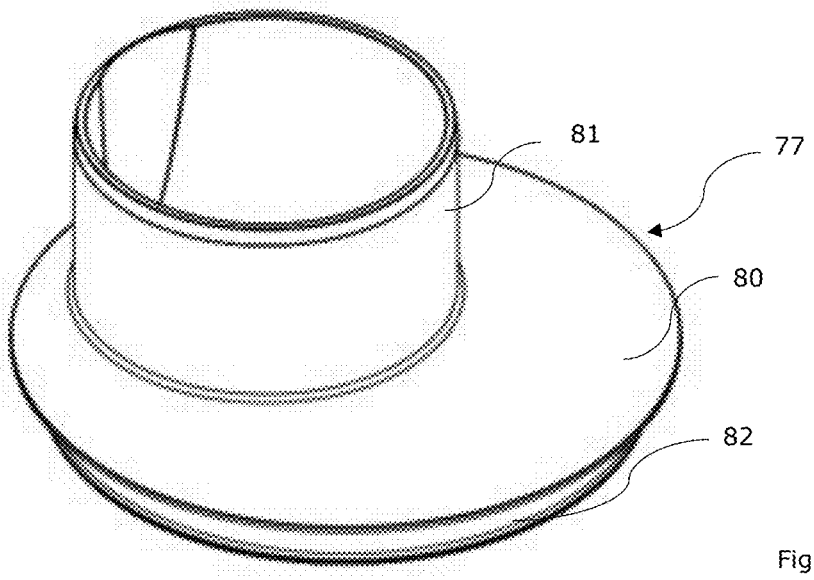
FIG. 26A and FIG. 26B are drawings of one embodiment of a cover with support ring.
Figure 26B:
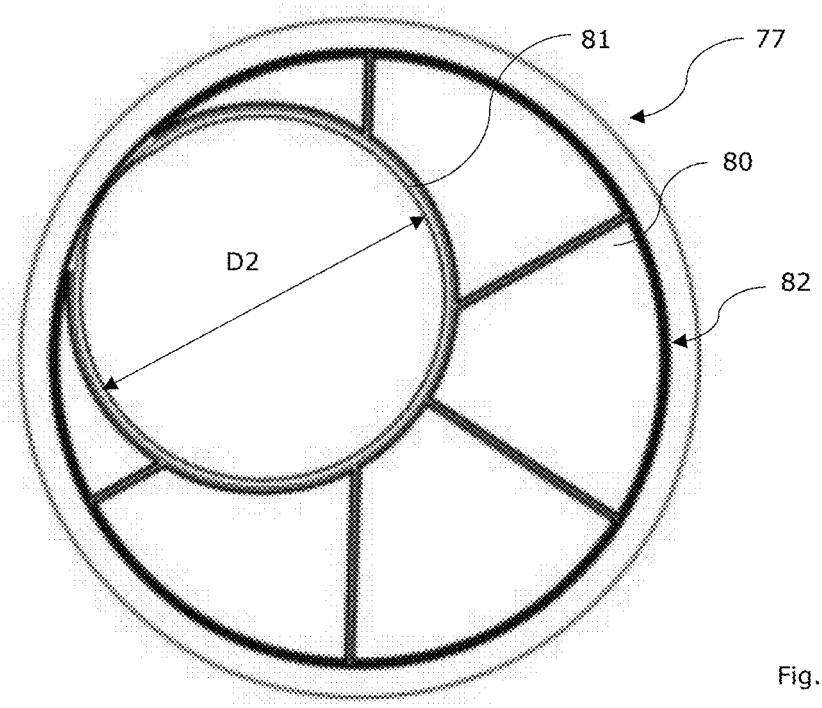

FIG. 26A and FIG. 26B show one embodiment a support ring 77 constituting a combination of a cover 80 with a circular shape, for a female through hole (not shown) of a cuboid, and a circular flange 81 for a drain pipe (not shown), respectively.

The cover 80 of the support ring 77 has a flange 82 having an outer diameter D2 corresponding to an inner diameter of the female through hole of the cuboid, which the support ring 77 is intended for being attached to. The circular flange 81 of the support ring 77 has an outer diameter D2 corresponding to an inner diameter of a standard drain pipe. Thereby, a standard drain pipe may be fitted to a cuboid by the support ring being attached to the cuboid and the standard drain pipe being fitted to the circular flange 81.

In the embodiment shown, the outer diameter D2 of the circular flange is 250 mm, corresponding to one size of standard drain pipes used for sewage or water drainage.

An outer diameter of the male flange 82 is preferably 500 mm, which is the same diameter as an outer diameter of one of a plurality of standard sized drain pipes. Another diameter of the male flange 82 may be selected, possibly being the same diameter as an outer diameter of another one of a plurality of standard sized drain pipes.

Figure 27A:
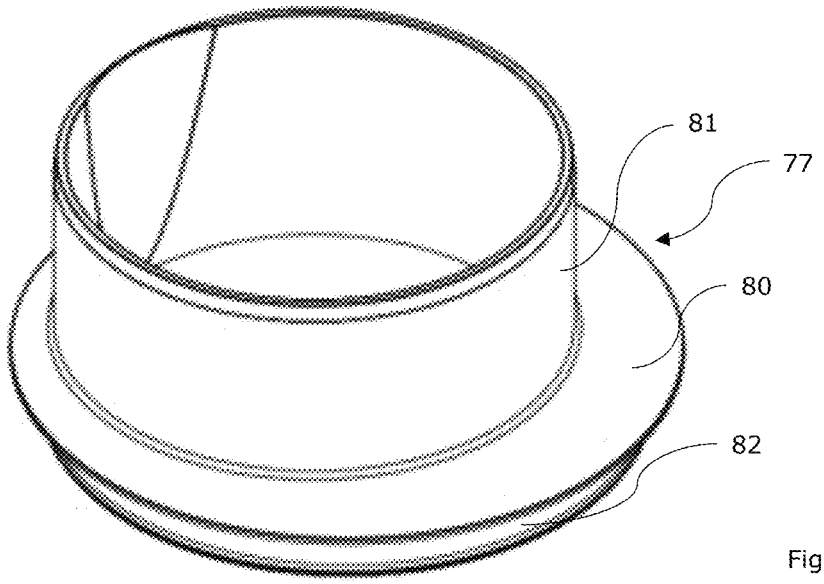
FIG. 27A and FIG. 27B are drawings of another embodiment of a cover with support ring.
Figure 27B:
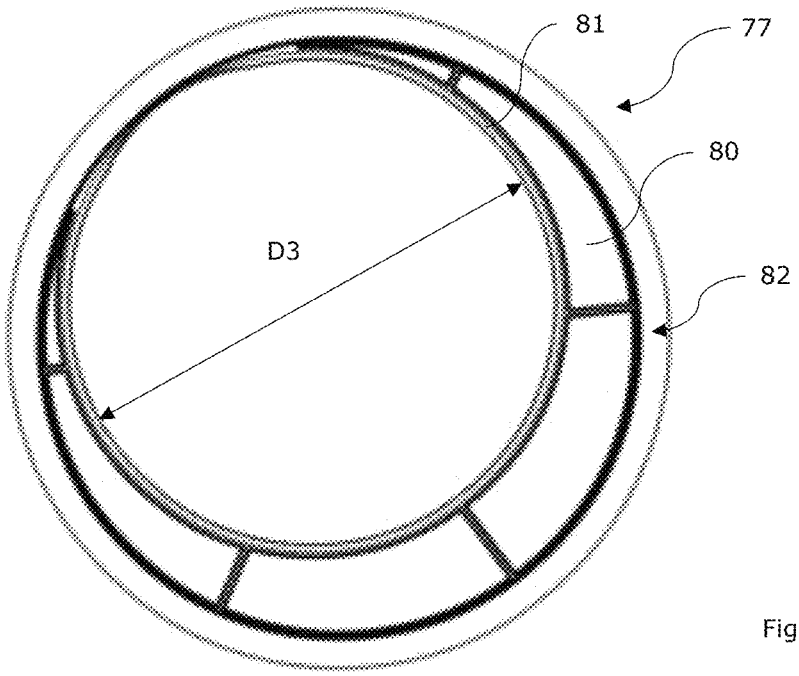

FIG. 27A and FIG. 27B show another embodiment a support ring 77 constituting a combination of a cover 80 with a circular shape, for a female through hole (not shown) of a cuboid, and a circular flange 81 for a drain pipe (not shown), respectively.

The cover 80 of the support ring 77 has a flange 82 having an outer diameter D3 corresponding to an inner diameter of the female through hole of the cuboid, which the support ring 77 is intended for being attached to. The circular flange 81 of the support ring 77 has an outer diameter D2 corresponding to an inner diameter of a standard drain pipe. Thereby, a standard drain pipe may be fitted to a cuboid by the support ring being attached to the cuboid and the standard drain pipe being fitted to the circular flange 81.

In the embodiment shown, the outer diameter D3 of the circular flange is 450 mm, corresponding to another size of standard drain pipes used for sewage or water drainage.

An outer diameter of the male flange 82 is preferably 500 mm, which is the same diameter as an outer diameter of one of a plurality of standard sized drain pipes. Another diameter of the male flange 82 may be selected, possibly being the same diameter as an outer diameter of another one of a plurality of standard sized drain pipes.

Figure 28:
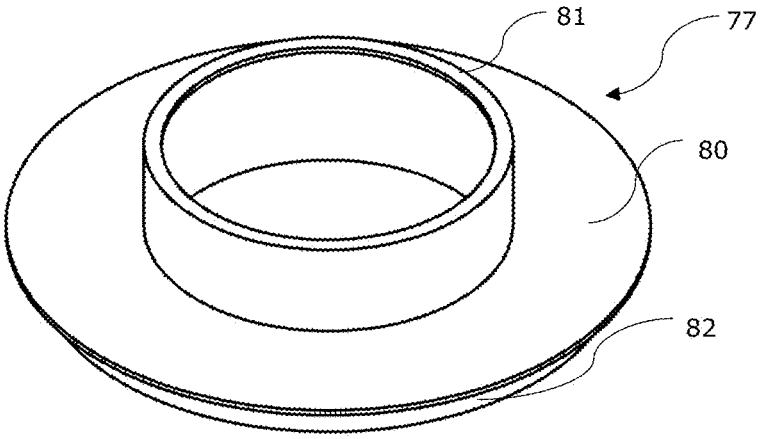
FIG. 28 and FIG. 29 are drawings of one embodiment of a support ring and a bucket
Figure 29:
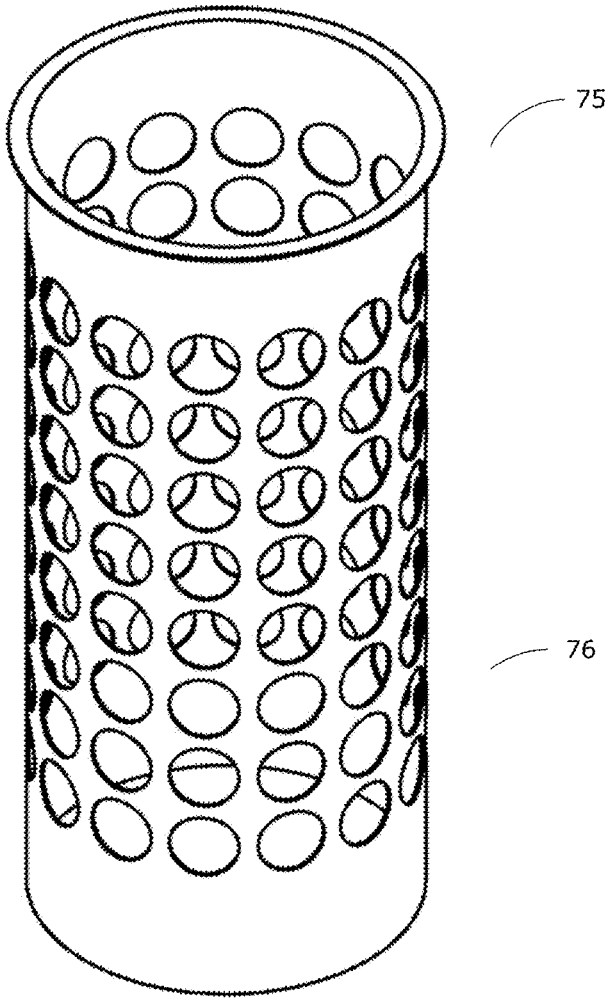

FIG. 28 and FIG. 29 show one embodiment of a support ring and a bucket, respectively.

The support ring 77 support the pipe 73 shown in FIG. 19. The support ring 77 may also support, as example, a wick insert 72 shown in FIG. 19. Other parts than a pipe 73 and bucket 75 or a wick insert 72 may be supported by a support ring 77 shown.

The support ring 77 has a support surface 80 with a circular shape. Alternatively, the centre plate has a rectangular shape. The support surface 80 is intended for being supported on an upper outer surface of a cuboid (see FIG. 20). The support ring 77 has one circular flange 81 with a relatively small diameter and extending upwards from the centre plate 80 and another flange 82 with a relatively larger diameter and extending downwards from the support surface 80.

The other flange 82 is intended for being inserted into a female through hole in the upper surface of a cuboid. The one flange 81 is intended for supporting an inner circumference of, as example, a pipe 73 as shown in FIG. 19 or for supporting an outer surface of, as example, a wick insert 72 as shown in FIG. 19.

Figure 30:
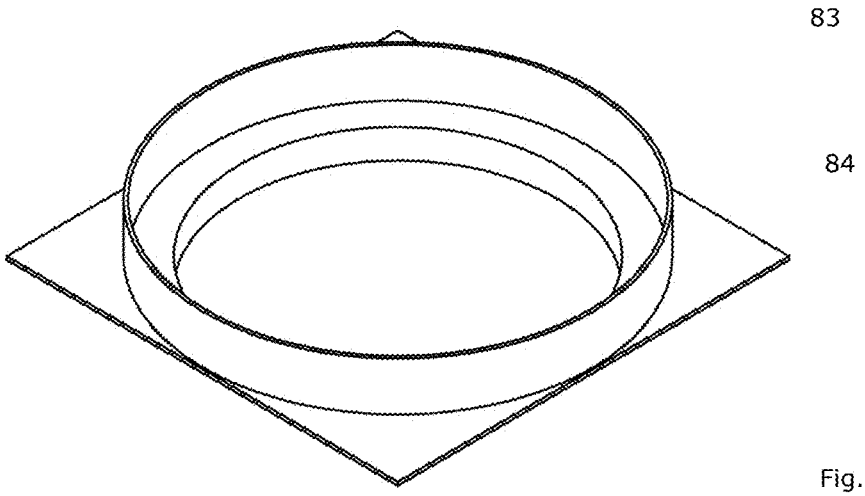
FIG. 30 and FIG. 31 are drawings of another embodiment of a support ring and a bucket.
Figure 31:
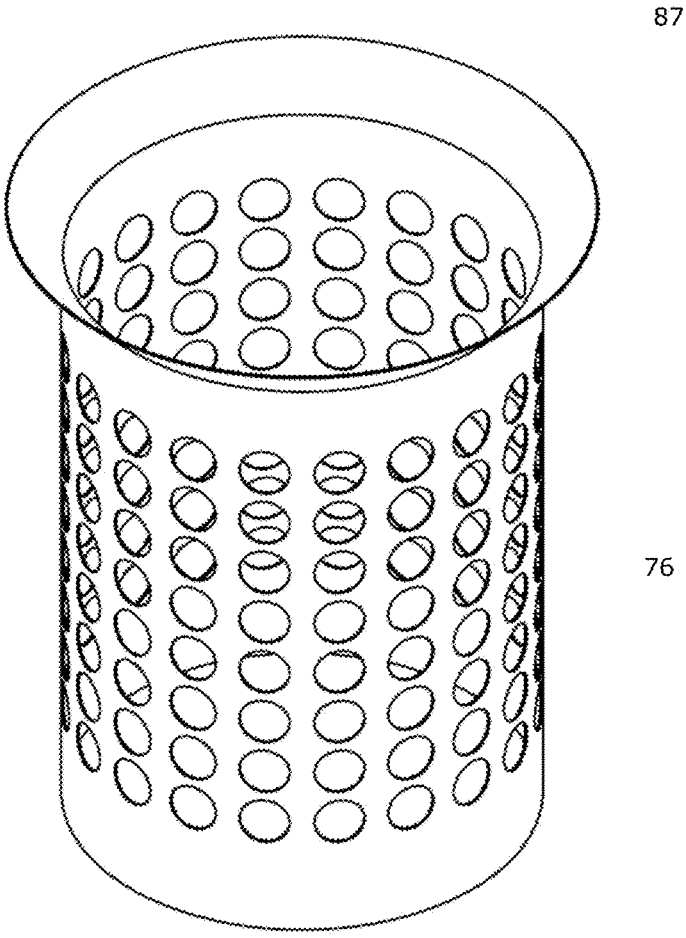

FIG. 30 and FIG. 31 show other embodiments of a support ring and a bucket, respectively The support ring 83 has a support surface 84 with a rectangular shape. Alternatively, the support surface has a circular shape. The support surface 84 is intended for being placed on an upper outer surface of a cuboid. The support ring 83 has one circular flange 85 with a relatively large diameter and extending upwards from the support surface 84 and another flange 86 with a relatively small diameter and extending downwards from the support surface 84.

The other flange 86 is intended for being inserted into a female through hole in the upper surface of the cuboid. The one flange 85 is intended for supporting an outer circumference of, as example, a pipe 73 or for supporting other elements extending between the support ring and the ground level beneath which the cuboid is buried.

Figure 32A:
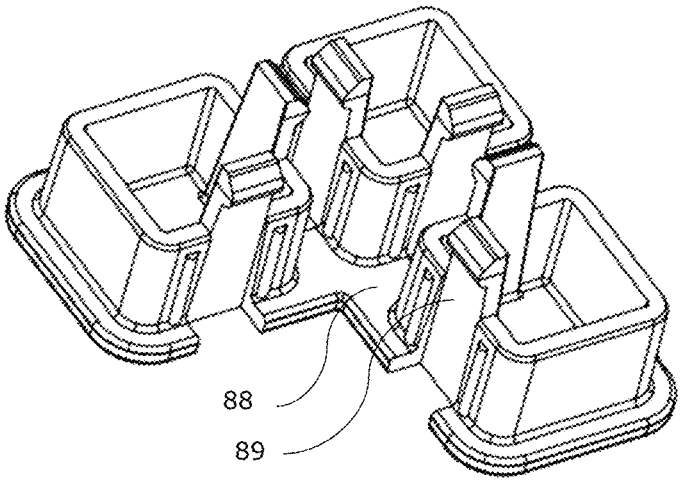
FIG. 32A and FIG. 32B are drawings of a corner lock for corners of neighbouring cuboids.
Figure 32B:
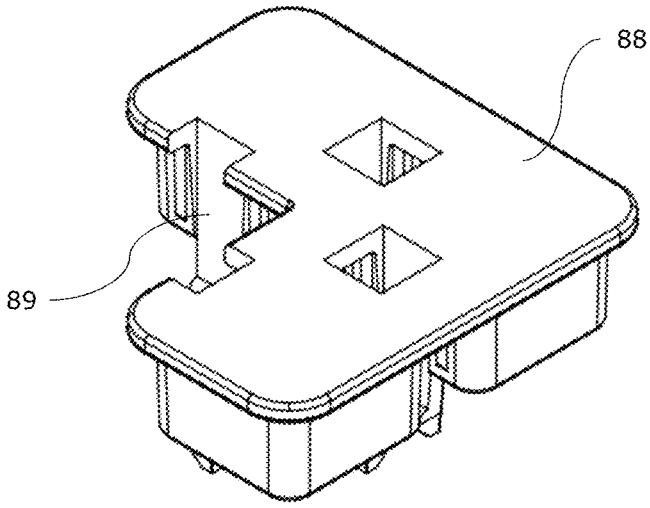

FIG. 32A and FIG. 32B show a possible embodiment of a locking part 88 for mutually locking corners of two neighbouring cuboids. The locking part 88 is provided with locking pins 89 extending from a mutual base plate 88. The locking pins 88 are intended for interacting with corresponding locking recesses at corners of the neighbouring cuboids (see FIG. 7A,7B and FIG. 8A,8B). When the locking pins 89 are inserted into the corresponding locking recesses at corners of neighbouring cuboids, the neighbouring cuboids are prevented from displacing laterally in relation to each other.

Figure 33:
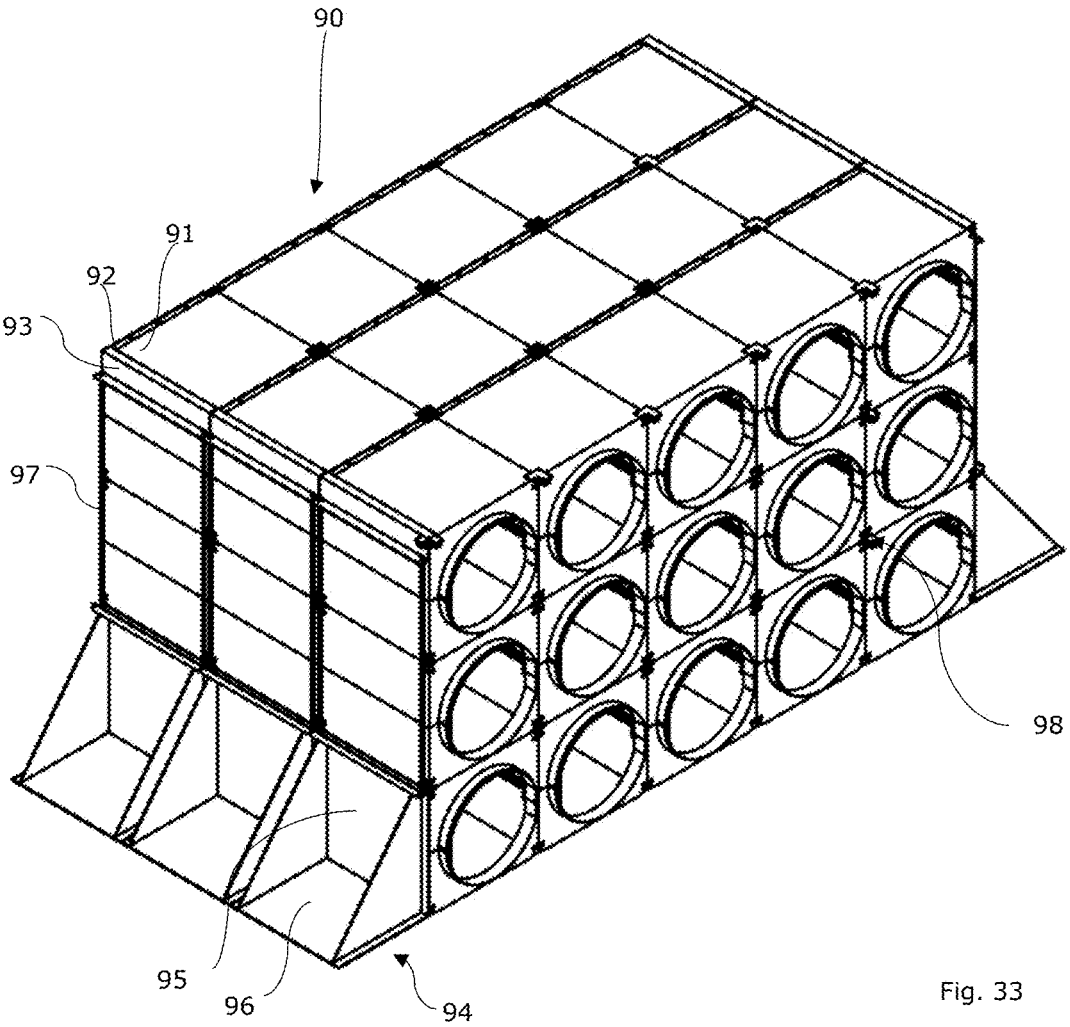
FIG. 33 is a drawing of a means for preventing displacement of the module system.

FIG. 33 shows another example of a modular system constituting and underground stormwater retention basins. In the example shown, forty-five cuboids of the first type of cuboid are combined. The example shown is not limiting any other configuration of cuboids and any other use of cuboids of the first type and/or cuboids of the second type of cuboids.

Braces 90 are provided at top sides of the uppermost cuboids to the left and to the right in the figure. The braces 90 are constituted by an S-shaped profile with an upper section 91 of the S-shaped profile extending along an edge of the upper surfaces of the uppermost cuboids to the left and to the right and in the figure and with a middle section 92 of the S-shaped profile extending along side surfaces of these uppermost cuboids. A lower section 93 of the S-shaped braces extends outwards from the middle section 92.

Troughs 94 are provided along side surfaces of the lowermost cuboids to the left and to the right in the figure. The troughs 91 are constituted by an L-shaped profile with an upward section 95 of the L-shaped profile extending along side surfaces of the lowermost cuboids to the left and to the right and with a lateral section 96 of the L-shaped profile extending perpendicular to the upward section 95 and outwards in extension of lowermost surfaces of the lowermost cuboids to the left and to the right.

Rods 97 are attached to the lower section 93 of the S-shaped braces 90 and to the upward extending sections 95 of the L-shaped troughs 94. The rods 97 connect the braces 90 with the troughs 94 so that the uppermost cuboids cannot displace form the throughs 94. When the cuboids are buried in the ground, the troughs 94 are filled with soil and the soil extends upwards along the side surfaces of the cuboids.

If possible underground forces beneath the cuboids, as example forces from underground water situated beneath the stack of cuboids and the troughs, try to force the stack of cuboids and the troughs upwards the soil in and above the troughs will prevent the troughs from displacing upwards by the possible underground forces.

Because the braces 90 along the upper edged of the uppermost cuboids to the left and to the right in the figure are connected with the troughs 94 via the rods 07, the braces 90 and the uppermost cuboids to the left and to the right are prevented from displacing upwards. Because all the cuboids in the stack of cuboids are mutually connected, also the remaining cuboids in the stack of cuboids are prevented from displacing upwards when possible underground forces try to force the stack of cuboids upwards.

Figure 34:
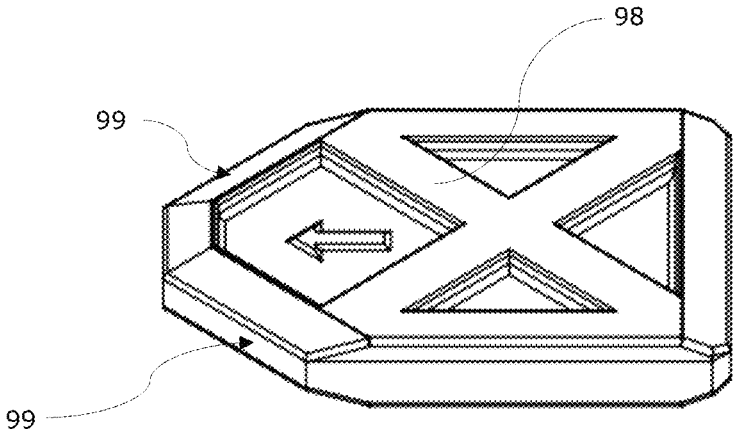
FIG. 34 is a drawing of a side lock for locking corners of neighbouring cuboids.

FIG. 34 shows a possible embodiment of a side locking part 97 for mutually locking sides of two neighbouring cuboids. The side locking part 97 is provided with locking wedges 98. The locking wedges 98 are intended for interacting with corresponding locking recesses at side edges of the neighbouring cuboids. When the locking wedges 98 are inserted into the corresponding locking recesses at side edges of neighbouring cuboids, the neighbouring cuboids are prevented from displacing upwards and downwards in relation to each other.

Figure 35:
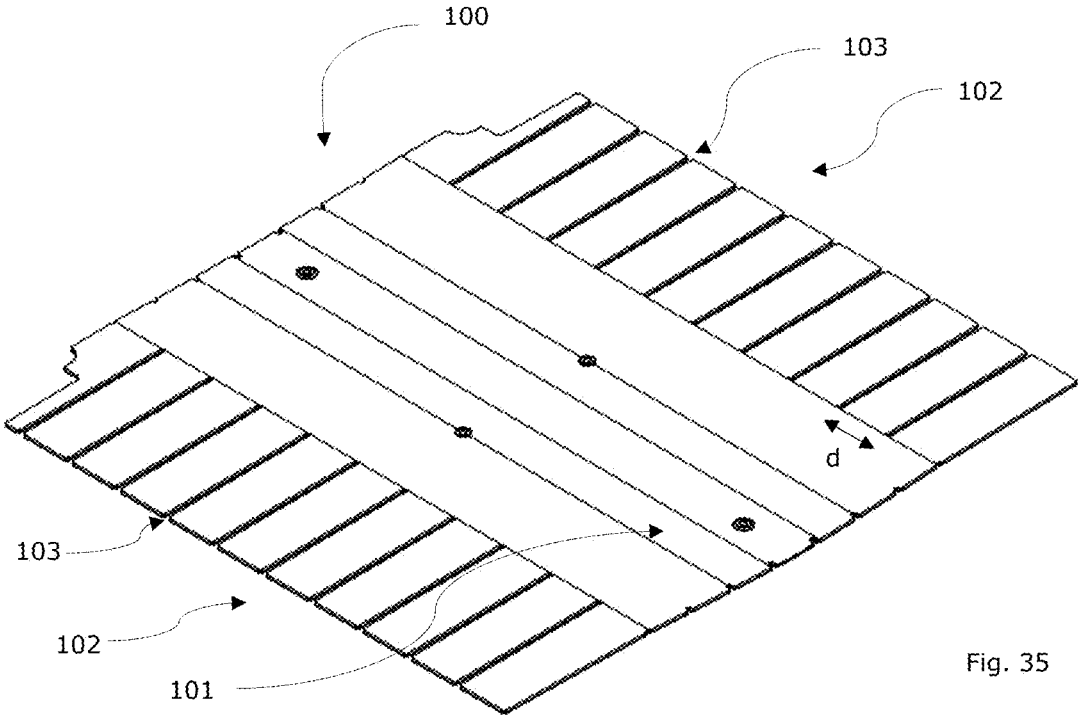
FIG. 35 is a drawing of a bottom plate for insertion into a full-sized or semi-sized cuboid.

FIG. 35 shows a bottom plate 100 intended for insertion in a bottom of a cuboid. The bottom plate 100 has a central section 101 and has side sections 102 extending along the central section. The side sections 102 are provided with grooves 103 extending from the central section 101 to an outer edge of the side sections 102. The grooves 103 are intended for interacting with ribs of the cuboid, see as example FIG. 10.

In the embodiment of the bottom plate 100 shown, the grooves 103 of the side sections 102 are dimensioned and mutually distanced at a distance d for interaction with support ribs 19 of a cuboid as shown in FIG. 10. Other dimensions and other distances between the grooves 103 may be provided for interaction with other embodiments of cuboids with other support ribs along inner surfaces, as example support ribs as shown in the embodiment in FIG. 7*a* and FIG. 7B.

The bottom plate 100 is intended for providing a plane surface in a bottom of a cuboid. The cuboid as shown in, as example, FIG. 10 has support ribs 19 provided along inner surfaces of the cuboid. As mentioned, the support ribs 19 are intended for giving the cuboid rigidity. However, the support ribs 19 in the bottom of the cuboid, and thereby interstices between the support ribs 19, may collect debris being passed along with stormwater passing into or passing through the cuboid. Such debris may have to be, or must be, removed, at regular intervals to ensure a sufficient flow of stormwater.

Providing a bottom plate 100 in the bottom of the cuboid avoids, or at least minimizes, debris collecting in the bottom of the cuboid. Accordingly, the bottom of the cuboid will not collect and store debris, or at least an amount of debris will be minimal. This is an advantage in avoiding any debris in the bottom of the cuboid being collected and possibly limiting flow of stormwater passing into or passing through the cuboid.

Figure 36A:
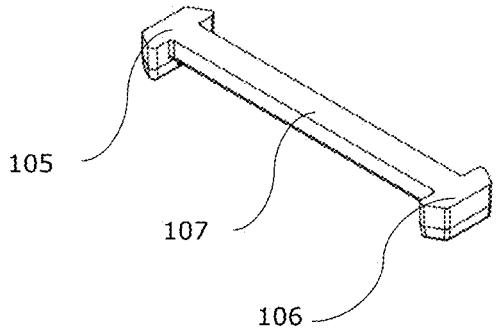
FIG. 36A-C are drawings of a locking member for locking together semi-sized parts of a cuboid.
Figure 36B:
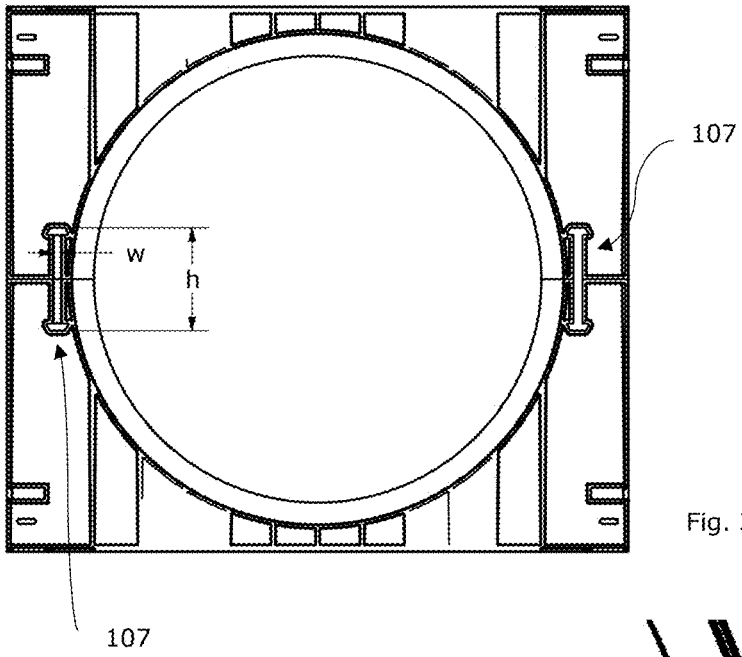
Figure 36C:
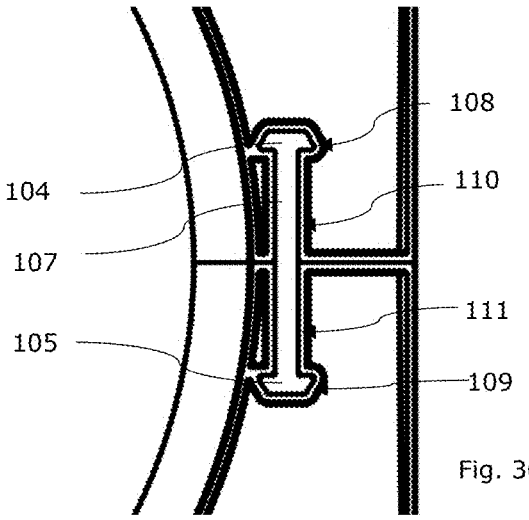

FIG. 36A-36C shows a possible embodiment for a locking member 104 for locking together an upper part and a lower part of a cuboid, additional to, or alternatively to, as example the locking recesses 35 and tenons 35A shown in FIG. 9A-9B The locking member 104 is elongated and have an enlargement 105, 106 in each end of an intermediate extension 107. The enlarged ends 105, 106 of the locking member 105 interact with corresponding cavities 108,109 in the upper part and in the lower part, respectively, of the cuboid.

The intermediate extension 107 of the locking member 105 interacts with corresponding cavities 110,111 in the upper part and the lower part, respectively, of the cuboid. In an alternative embodiment, only the cavities 108,109 which the enlarged ends 105,106 of the locking member 104 interact with, is provided in the upper part and the lower part, respectively, of the cuboid. The enlarged ends 105,106 of the locking member 104 may have other shapes than a trapeze as shown in the embodiment, as example a shape as a triangle, a parallelogram or other polygonals, or may have more or less rounded shapes.

In the embodiment shown a width w of the intermediate section 107 is 10 mm and the length is 116 mm. A width of the enlarged end sections 105, 106 is at least 1.5 times larger, preferably at least 2 times larger, than the width w of the intermediate section.

The locking member shown in the figure is intended for being inserted into the cavities of the upper part and the lower part of the cuboid when the upper part and the lower part has been assembled edge to edge. A plurality of locking members is provided along the edges, where the upper part and the lower part of the cuboid are assembled. The plurality of locking members locks the upper part and the lower part together, avoiding the upper part and the lower part being released from each other when in the ground.

Figure 37:
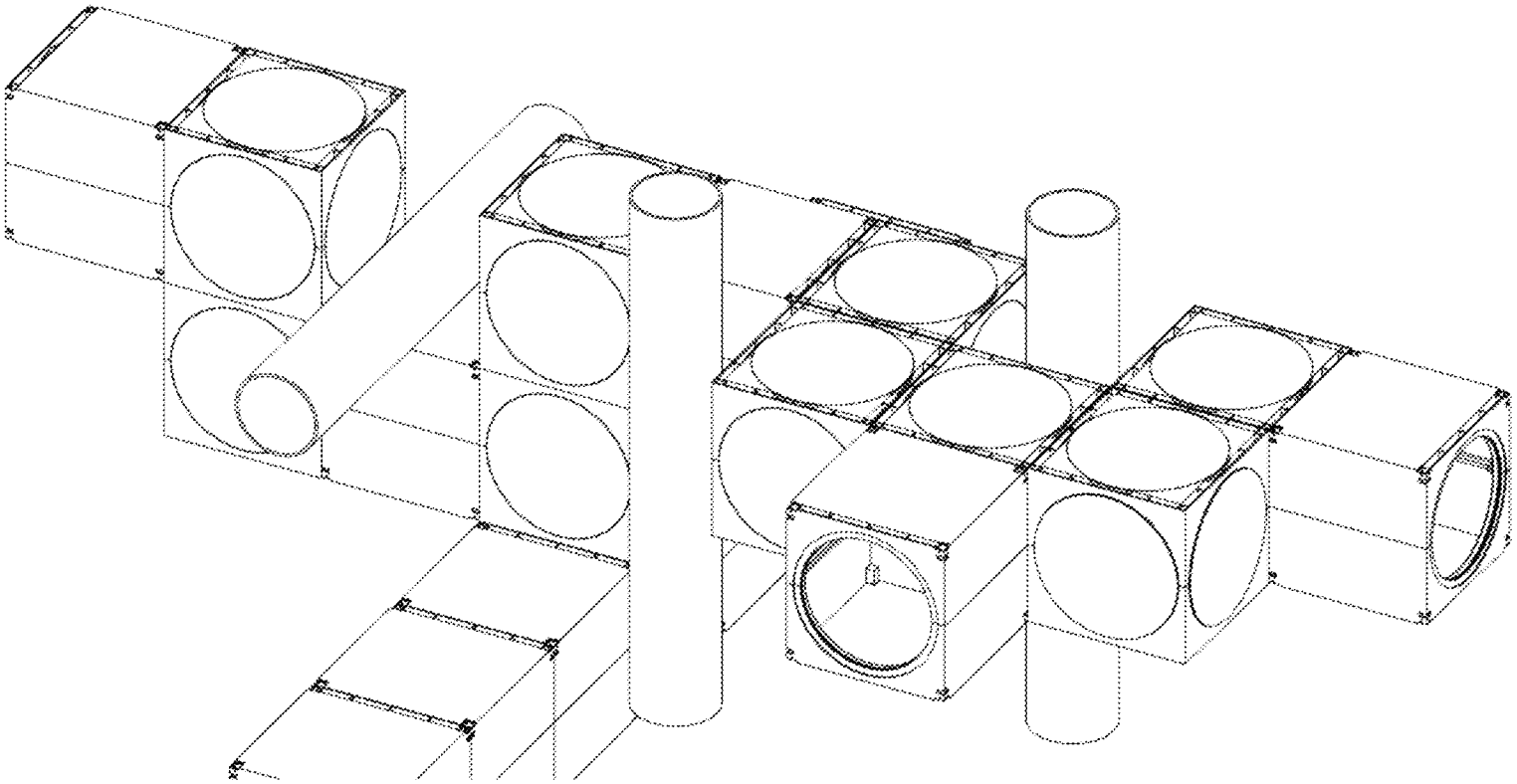
FIG. 37 is a drawing of another module system of an underground stormwater retention basin.

FIG. 37 shows a possible layout of a module system for use as an underground stormwater retention basin. In the layout shown, only cuboids of the first type are shown. However, also, or only, cuboids of the second type may be incorporated into the layout, depending on the needs and choices which the module system is to fulfil.

The layout shows that layout of the module system may be designed depending on any exterior obstacles which may be present underground in situ where the module system is to be provided. Sewage ducts, central heat ducts, vent ducts, gas and water pipes, electrical and telecommunication wiring and other underground obstacles may be evaded by the module system. Obstacles may also be roots of trees, foundations of building, poles for road barriers, trash bins or other above-ground-based appliances.

Another advantage of the cuboids shown is that if it becomes necessary to dig out one or more cuboids to access possible installations underground, and situated underneath the module system, a cuboid may be dug out and replaced it with a new other cuboid, if the other new cuboid is of the type shown in FIG. 6 with only female through holes.

Once one or more already buried cuboids have been dug out of the ground, and after the possible installations underneath the module system have been maintained, one or more new cuboids must be installed to replace the cuboids having been dug out to gain access to the installations. This is possible using a cuboid with only female through holes, because no flanges extend outside the side surfaces of the cuboid. Such flanges, if provided, would otherwise obstruct passage of a cuboid between two, three or four neighbouring cuboids, sideways to the new cuboid, and already placed in the ground.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A unit for a module system for use as underground stormwater retention basin, the unit being a three-dimensional unit comprising at least one main surface and at least three side surfaces, each said side surface extends from a common boundary between the at least one main surface and the respective side surface, and where neighbouring side surfaces are angled in relation to each other, each of the side surfaces having side edges extending from corners of the at least one main surface, and each of the side edges of one side surface being mutually joined with a side edge of another, neighbouring side surface, where the three-dimensional unit has an inner volume and at least one through hole in one of the side edges, said three-dimensional unit either allowing water to be contained inside the three-dimensional unit or, with the proviso of the three-dimensional unit having at least two through holes, allowing water to pass through the three-dimensional unit from one through hole in one side surface to another through hole in another side surface, and where the at least one through hole is either a female through hole or a male through hole, and with the proviso that the through hole is a female through hole, the through hole is for insertion of an insert flange of a male through hole of another three-dimensional unit, and with the proviso that the through hole is a male through hole, the through hole has an insert flange for insertion into a female through hole of another three-dimensional unit which three-dimensional unit is made from at least two individual parts being mutually joined, thereby forming an inner volume of the three-dimensional unit, each individual part having at least parts of both the main surface and the side surfaces, and at least one of the at least two individual parts having at least one of the following: part of a female through hole, part of a male through hole, an entire female through hole, an entire male through hole, and where at least part of each of the side surfaces has a free edge directed oppositely to the common boundary between the at least one main surface and each of the side surfaces, each of said free edges having means for connecting, in a watertight manner, with free edges of side surfaces of another individual part of the three-dimensional unit enabling forming a watertight three-dimensional unit made from the at least two individual parts, the means for connecting, in a watertight manner, the free edges with free edges of closed side surfaces of another individual part of the three-dimensional unit consisting in at least one of a longitudinal bead and a longitudinal groove, said longitudinal bead or longitudinal groove intended for engaging a corresponding groove and bead, respectively, along free side edges of closed side surfaces of another individual part of the three-dimensional unit, and an elastomeric liner provided in the longitudinal groove of the individual part or engaging a longitudinal bead of the individual part, and if the elastomeric liner is engaging a longitudinal groove, the elastomeric liner intended for also engaging a corresponding bead along free side edges of closed side surfaces of another individual part of the three-dimensional unit, and if the elastomeric liner is engaging a longitudinal bead, the elastomeric liner intended for also engaging a corresponding groove along free side edges of closed side surfaces of another individual part of the three-dimensional unit.

2. The unit according to claim 1, where the female through hole has a support flange extending along a circumference of the female through hole, said support flange intended for limiting an axial extension of a ring-shaped seal, and where the male through hole has an insert flange intended for being inserted into a female through hole of a neighbouring unt, and an outer circumference of the insert flange intended for holding the ring-shaped seal.

3. The unit according to claim 1, where at least three side surfaces have free side edges extending opposite to common boundaries between the at least one main surface and the side surfaces, where the free side edges extend between the joined edges so that the free edges constitute a circumference of an opening of a semi-sized part of a three-dimensional unit, the opening not being a through hole, the opening intended for being closed by the free edges of the one semi-sized part of the three-dimensional unit being assembled with, in a watertight manner, congruent free edges of another semi-sized part of the three-dimensional unit, and at least one side surface of the semi-sized part of the three-dimensional unit having a part of a through hole, the part of the through hole preferably being a part of one of a female through hole or a male through hole.

4. The unit according to claim 1, where the three-dimensional unit is selected among the following unit shapes: a cuboid, such as a cube, and with right angles between all surfaces, a cuboid, such as a cube, and with non-right angles between at least some of the surfaces, a prism with polygonal cross-section of the at least one main surface, where the polygonal cross-section of the prism preferably being an equilateral triangular shape or an equilateral hexagonal shape, a cylinder with polygonal cross-section of the at least one main surface, and where the polygonal cross-section of the cylinder preferably being an equilateral triangular shape or an equilateral hexagonal shape, a cylinder with a circular cross-section or an oval cross-section of the at least one main surface.

5. The unit according to claim 1, where the three-dimensional unit is manufactured by one of the following processes: casting or moulding as a full-sized three-dimensional unit a module system, said unit having a geometry and size of a full-sized tree-dimensional unit for the module system.

6. The unit according to claim 1, where the three-dimensional unit is manufactured by one of the following processes: casting or moulding of parts having a semi-size of the three-dimensional unit and having a geometry and size being a division of a full-sized unit.

7. The unit according to claim 1, the three-dimensional unit being a full-sized cuboid made from at least two semi-sized parts of the full-sized cuboid, said full-sized cuboid constituted by two substantially rectangular main surface being mutually parallel and four side surfaces, each of the side surfaces having common boundaries between the one main surface and the respective side surface and between the respective side surface and other neighbouring side surfaces, said side surfaces extending perpendicular from edges between the two main surfaces and the side surfaces and opposite said side surfaces being mutually parallel, at least two of the four side surfaces each having side edges provided by connecting free side edges of one semi-sized part of the cuboid with free edges of the other semi-sized part of the cuboid, and at least one other side surface having a part of a through hole, the part of the through hole preferably being a part of a substantially full-circular through hole, where the full-sized cuboid provides an inner volume either allowing water to be contained inside the cuboid or allowing water to pass through the cuboid from one through hole in one surface to another through hole in another surface, with the proviso of the cuboid having at least two through holes, where each through hole is one of a female through hole or a male through hole, and with the proviso that the through hole is a female through hole, the through hole is for insertion of a flange of a male through hole, and with the proviso that the part is one of a male through hole, the through hole has a flange for insertion into a female through hole.

8. The unit according to claim 7, where a length of two first opposite parallel side surface in a direction parallel to the main surface and a length of the two other second parallel side surfaces-in a direction parallel to the main surfaces are the same, the semi-sized part of the cuboid thereby having substantially square main surfaces, and where an extension of the side surfaces in a direction perpendicular to the main surface is substantially the same as the extension of the side surfaces parallel with the main surfaces, the semi-sized part of the cuboid component thereby forming a full-sized cuboid having a substantially cubic shape.

9. The unit according to claim 1, the three-dimensional unit being a semi-sized part of a cuboid constituted by one substantially rectangular main surface and four side surfaces, said side surfaces extending perpendicular from edges between the one main surface and the side surfaces and opposite said side surfaces being mutually parallel, each of the side surfaces having common boundaries between the one main surface and the respective side surface and between the respective side surface and other neighbouring side surfaces, at least two of the four side surfaces each having free side edges extending opposite to and parallel with the common boundaries between the one main surface and each of the at least two side surfaces, and at least one other side surface having a part of a through hole, the part of the through hole preferably being a part of a substantially semi-circular through hole, where at least part of the free side edges, directed oppositely to the common boundaries between the main surface and the side surfaces are provided with means for connecting the free side edges of the semi-sized part of the cuboid with free side edges of another semi-sized part of the cuboid to form a full-sized cuboid, and where the part of the through hole is one of a female through hole or a male through hole, and with the proviso that the part is one of a female through hole, the part is a hole for insertion of a flange of a male through hole, and with the proviso that the part is one of a male through hole, the part is a flange for insertion into a female through hole.

10. The unit according to claim 9, where a length of two first opposite parallel side surfaces in a direction parallel to the main surface and a length of the two other second parallel side surfaces in a direction parallel to the main surface are the same, the semi-sized part of the cuboid thereby having a substantially square main surface, and where an extension of the side surfaces in a direction perpendicular to the main surface is substantially half the extension of the side surfaces in a direction parallel to the main surface, the semi-sized part of the cuboid thereby forming substantially a semi-sized part of a cubic shape.

11. A part for a module system for use in an underground stormwater retention basin comprising a plurality of three-dimensional units according to claim 1, the part constituting a main surface being separate from side surfaces of the three-dimensional unit, and being intended for constituting part of a semi-sized part of a cuboid or part of a full-sized cuboid, the separate main surface being provided with means for engaging corresponding means of engagement of the side surfaces of the cuboid in order for the separate main surface to be part of the cuboid.

12. An underground stormwater retention basin constituting a module system comprising a plurality of three-dimensional units according to claim 1 and being buried in the ground below a ground level of the site, where the stormwater retention basin is situated, a number of the plurality of three-dimensional units constituting uppermost three-dimensional units towards the ground level, and a distance between an upper main surface of at least one of the uppermost three-dimensional units and the ground level being less than 80 cm, preferably less than 60 cm, possibly less than 40 cm.

13. A method of building an underground stormwater retention basin constituting a module system comprising a plurality of three-dimensional units according to claim 1, the method comprising the steps of:

providing a plurality of three-dimensional units of a first type made from two individual parts being mutually joined, thereby forming an inner volume of the three-dimensional units of a first type, and assembling on site of the underground stormwater retention basin the plurality of full-sized cuboids by the following method of assembling:

inserting a flange of a male through hole at a side surface of one cuboid into a female through hole at an opposing side surface of another neighbouring cuboid for assembling a plurality of cuboids of a first type of cuboid, and providing a ring-shaped seal between an outer circumference of the flange of the male through hole of the one cuboid and an inner circumference of the female through hole of the other neighbouring cuboid.

14. Use of a plurality of three-dimensional units according to claim 1 for building an underground stormwater constituting a module system comprising a plurality of three-dimensional units according to claim 1 and being buried in the ground below a ground level of the site, where the stormwater retention basin is situated, a number of the plurality of three-dimensional units constituting uppermost three-dimensional units towards the ground level, and a distance between an upper main surface of at least one of the uppermost three-dimensional units and the ground level being less than 80 cm, preferably less than 60 cm, possibly less than 40 cm.

* * * * *